US012065825B2

(12) United States Patent
Amini

(10) Patent No.: US 12,065,825 B2
(45) Date of Patent: Aug. 20, 2024

(54) EXTRUSION PROFILE BRACKET FOR PANEL MOUNTING

(71) Applicant: Alumax Panel Inc., Aurora (CA)

(72) Inventor: Mostafa Amini, Newmarket (CA)

(73) Assignee: Alumax Panel Inc., Aurora (CA)

( * ) Notice: Subject to any disclaimer, the term of this patent is extended or adjusted under 35 U.S.C. 154(b) by 0 days.

(21) Appl. No.: 18/462,873

(22) Filed: Sep. 7, 2023

(65) Prior Publication Data

US 2024/0084581 A1 Mar. 14, 2024

(30) Foreign Application Priority Data

Sep. 9, 2022 (CA) ..... CA 3172914

(51) Int. Cl.
*E04B 1/38* (2006.01)
*E04F 13/00* (2006.01)

(52) U.S. Cl.
CPC ..... *E04B 1/388* (2023.08); *E04B 2001/389* (2023.08)

(58) Field of Classification Search
CPC . E04B 1/388; E04B 2001/389; E04F 13/0801
USPC ..... 52/506.05
See application file for complete search history.

(56) References Cited

U.S. PATENT DOCUMENTS 3,225,502 A * 12/1965 Hallauer ..... E06B 3/60 52/775
3,349,533 A 10/1967 Gregoire
3,481,572 A 2/1969 Casebolt et al.
3,712,005 A 1/1973 Eschbach et al.
3,858,377 A * 1/1975 Browne ..... E04B 1/6116 52/775

(Continued)

FOREIGN PATENT DOCUMENTS

| | | |
|---|---|---|
| EP | 0 340 607 B1 | 1/1993 |
| EP | 0 576 760 B1 | 1/1997 |
| EP | 1 876 313 A2 | 1/2008 |

OTHER PUBLICATIONS

Office Action issued in Canadian Patent Application No. 3,172,914, dated Feb. 1, 2023.

(Continued)

*Primary Examiner* — James J Buckle, Jr.
(74) *Attorney, Agent, or Firm* — BENESCH, FRIEDLANDER, COPLAN & ARONOFF LLP

(57) ABSTRACT

An extrusion profile bracket for mounting panels comprises a mounting base, a first support leg extending from the mounting base, and a brace extending from the mounting base and spaced apart from the first support leg. The first support leg has a plurality of first support leg panel gripping teeth extending from the first support leg toward the brace and terminates in a first support foot including a portion extending oppositely to the first support leg panel gripping teeth and away from the brace. The first support foot has a first locking heel extending toward the brace and extending beyond termini of the first support leg panel gripping teeth. The brace has a plurality of brace first panel gripping teeth extending toward the first support leg panel gripping teeth, and the first support leg panel gripping teeth and the brace first gripping teeth are arranged in opposition to one another.

13 Claims, 22 Drawing Sheets

(56) References Cited

U.S. PATENT DOCUMENTS 4,067,155 A * 1/1978 Ruff ..... E04B 1/6803 52/287.1
4,788,806 A * 12/1988 Sease ..... B44C 7/022 160/395
5,603,192 A 2/1997 Dickson
5,678,383 A * 10/1997 Danielewicz ..... E04D 3/14 52/235
6,115,982 A * 9/2000 Lindenberg ..... A47B 77/022 52/287.1
6,287,046 B1 * 9/2001 Neuhofer, Jr. ..... E04F 19/0463 16/16
6,345,480 B1 * 2/2002 Kemper ..... E04F 19/067 52/717.03
6,427,408 B1 8/2002 Krieger
6,588,165 B1 7/2003 Wright
6,729,092 B2 * 5/2004 Grosjean ..... E04F 19/066 52/395
6,760,990 B2 7/2004 Lowndes
7,562,504 B2 * 7/2009 Herbst ..... E04F 13/0889 52/762
7,621,084 B2 11/2009 Bilge
7,802,408 B2 9/2010 Asbury
8,127,507 B1 3/2012 Bilge
9,051,741 B2 6/2015 Bilge
9,068,353 B1 * 6/2015 Kovalchuk ..... E04F 13/12
9,091,079 B2 * 7/2015 Wright ..... E04F 13/0898
9,328,517 B2 * 5/2016 Bilge ..... E04F 13/0889
9,903,123 B1 * 2/2018 Simonsen ..... E04F 13/0801
10,208,484 B1 * 2/2019 Simonsen ..... E04F 13/0891
10,233,652 B1 * 3/2019 Hogan ..... E04B 9/26
10,612,247 B2 * 4/2020 Simonsen ..... E04F 13/12
10,815,671 B2 * 10/2020 Koetje ..... E04F 13/0891
11,674,322 B2 * 6/2023 Richardson ..... E04G 17/001 52/742.14
11,834,828 B2 * 12/2023 Heesbeen ..... E04B 9/16
2002/0124514 A1 9/2002 Higgins
2010/0037549 A1 2/2010 Lynch et al.
2012/0096799 A1 4/2012 Wright
2014/0196394 A1 * 7/2014 Greeson ..... A47B 96/1466 52/404.4
2015/0308123 A1 * 10/2015 Prica ..... E04F 13/0889 52/483.1
2016/0145875 A1 * 5/2016 Scully ..... E04F 13/14 52/698
2016/0298338 A1 * 10/2016 Libreiro ..... E04F 13/0821
2023/0235550 A1 * 7/2023 Long ..... E04B 1/388 52/235
2023/0243148 A1 * 8/2023 Taylor ..... E04F 10/00 52/65

OTHER PUBLICATIONS

Notice of Allowance issued in Canadian Patent Application No. 3,172,914, dated May 31, 2023.

* cited by examiner

EXTRUSION PROFILE BRACKET FOR PANEL MOUNTING

CROSS-REFERENCE TO RELATED APPLICATION

This application claims priority to Canadian Patent Application No. 3,172,314, filed on Sep. 9, 2022, and titled "Extrusion Profile Bracket for Panel Mounting," which is hereby incorporated by reference in its entirety.

TECHNICAL FIELD

The present disclosure relates to panel mounting.

BACKGROUND

Exterior paneling is often used to provide a finished appearance on buildings. The panels are conventionally mounted to building walls by first securing the panels to a perimeter support formed from lengths of extrusion, typically of aluminum, with corner brackets used to secure the lengths of extrusion together to form the support. Typically the corner brackets and the lengths of extrusion are riveted together. Clips are then fastened to the lengths of extrusion, e.g. by self-tapping screws, and then the clips are secured to the building wall to mount the supported panel on the wall.

This is a complex and labor intensive process, as it requires the panels be attached to the extrusions, which must also be connected together by the corner brackets, and then separate clips must be used for mounting. Moreover, each of the multitude of components needed for mounting contributes to material cost, adding to the expense of the conventional mounting arrangements.

SUMMARY

Broadly speaking, the present disclosure is directed to an extrusion profile bracket that can be mounted directly to a wall, ceiling, floor or similar surface without the need for separate clips, and which can securely mount exterior panels without need of corner brackets or additional fasteners to secure the panels to the extrusion profile bracket.

In one aspect, an extrusion profile bracket for mounting panels comprises a mounting base, a first support leg extending from the mounting base, and a brace extending from the mounting base and spaced apart from the first support leg. The first support leg has a plurality of first support leg panel gripping teeth extending from the first support leg toward the brace. The first support leg terminates in a first support foot including a portion extending oppositely to the first support leg panel gripping teeth and away from the brace. The first support foot has a first locking heel extending toward the brace and extending beyond termini of the first support leg panel gripping teeth. The brace has a plurality of brace first panel gripping teeth extending toward the first support leg panel gripping teeth. The first support leg panel gripping teeth and the brace first panel gripping teeth are arranged in opposition to one another.

In one embodiment, the first support leg comprises a first generally planar calf portion that carries the first support leg panel gripping teeth and terminates in the first support foot, and a first curved thigh portion extending between the first calf portion and the mounting base and having a concave curvature facing the brace. The curvature of the first thigh portion may provide a resilient bias of the first calf portion toward the brace.

In some embodiments, the extrusion profile further comprises a second support leg extending from the mounting base on an opposite side of the brace from the first support leg. The second support leg has a plurality of second support leg panel gripping teeth extending from the second support leg toward the brace. The second support leg terminates in a second support foot including a portion extending oppositely to the second support leg panel gripping teeth and away from the brace. The second support foot has a second locking heel extending toward the brace and extending beyond termini of the second support leg panel gripping teeth. The brace has a plurality of brace second panel gripping teeth extending toward the second support leg panel gripping teeth. The second support leg panel gripping teeth and the brace second panel gripping teeth are arranged in opposition to one another.

The second support leg may comprise a second generally planar calf portion that carries the second support leg panel gripping teeth and terminates in the second support foot, and a second curved thigh portion extending between the second calf portion and the mounting base and having a concave curvature facing the brace. The curvature of the second thigh portion may provide a resilient bias of the second calf portion toward the brace.

In some embodiments, the first support leg, the second support leg and the brace form a substantially symmetrical arrangement.

An extrusion profile bracket having a first support leg as described above may form part of a composite panel system that further comprises a first panel. The first panel comprises a first panel facing and a first panel mounting flange depending generally orthogonally from an end of the first panel facing to form a first panel corner between the first panel facing and the first panel mounting flange. The first panel has a first panel inner surface facing toward the first support leg and a first panel outer surface facing away from the first support leg, and a first panel notch is formed in the first panel inner surface at the first panel corner. The first panel mounting flange is received between the first support leg and the brace and is gripped by the first support leg panel gripping teeth and the brace first panel gripping teeth. The first support foot abuts the first panel facing on the first panel inner surface, and the first locking heel extends into the first panel notch to obstruct withdrawal of the first panel mounting flange from between the first support leg and the brace.

In some embodiments, the first panel is a composite panel wherein the first panel inner surface and the first panel outer surface are formed by respective first panel metal layers and wherein a first panel intermediate layer of filler is disposed between the first panel metal layers. In such embodiments, the first panel notch may extend entirely through the first panel metal layer forming the first panel inner surface and into the first panel intermediate layer of filler.

An extrusion profile bracket having a first support leg and a second support leg as described above may form part of a composite panel system further comprising a first panel and a second panel. The first panel comprises a first panel facing and a first panel mounting flange depending generally orthogonally from an end of the first panel facing to form a first panel corner between the first panel facing and the first panel mounting flange. The first panel has a first panel inner surface facing toward the first support leg and a first panel outer surface facing away from the first support leg, and a first panel notch is formed in the first panel inner surface at the first panel corner. The second panel comprises a second panel facing and a second panel mounting flange depending generally orthogonally from an end of the second panel facing to form a second panel corner between the second panel facing and the second panel mounting flange. The second panel has a second panel inner surface facing toward the second support leg and a second panel outer surface facing away from the second support leg, and a second panel notch is formed in the second panel inner surface at the second panel corner. The first panel mounting flange is received between the first support leg and the brace and is gripped by the first support leg panel gripping teeth and the brace first panel gripping teeth, the first support foot abuts the first panel facing on the first panel inner surface, and the first locking heel extends into the first panel notch to obstruct withdrawal of the first panel mounting flange from between the first support leg and the brace. The second panel mounting flange is received between the second support leg and the brace and is gripped by the second support leg panel gripping teeth and the brace second panel gripping teeth, the second support foot abuts the second panel facing on the second panel inner surface, and the second locking heel extends into the second panel notch to obstruct withdrawal of the second panel mounting flange from between the second support leg and the brace.

In some embodiments, the first panel is a composite panel wherein the first panel inner surface and the first panel outer surface are formed by respective first panel metal layers and wherein a first panel intermediate layer of filler is disposed between the first panel metal layers, and the second panel is a composite panel wherein the second panel inner surface and the second panel outer surface are formed by respective second panel metal layers and wherein a second panel intermediate layer of filler is disposed between the second panel metal layers. In such embodiments, the first panel notch may extend entirely through the first panel metal layer forming the first panel inner surface and into the first panel intermediate layer of filler, and the second panel notch may extend entirely through the second panel metal layer forming the second panel inner surface and into the second panel intermediate layer of filler.

In another aspect, an extrusion profile bracket for mounting panels comprises a mounting base, a first support leg extending from the mounting base, and a second support leg extending from the mounting base opposite the first support leg. The first support leg has a plurality of first support leg panel gripping teeth extending from the first support leg toward the second support leg. The first support leg terminates in a first support foot including a portion extending oppositely to the first support leg panel gripping teeth and away from the second support leg. The first support foot has a first locking heel extending toward the second support leg and extending beyond termini of the first support leg panel gripping teeth, and the second support leg has a plurality of second support leg panel gripping teeth extending from the second support leg toward the first support leg. The second support leg terminates in a second support foot including a portion extending oppositely to the second support leg panel gripping teeth and away from the first support leg. The second support foot has a second locking heel extending toward the first support leg and extending beyond termini of the second support leg panel gripping teeth. The first support leg panel gripping teeth and the second support leg panel gripping teeth are arranged in opposition to one another.

BRIEF DESCRIPTION OF THE DRAWINGS

These and other features of the disclosure will become more apparent from the following description in which reference is made to the appended drawings wherein.

DETAILED DESCRIPTION

Figure 1A:
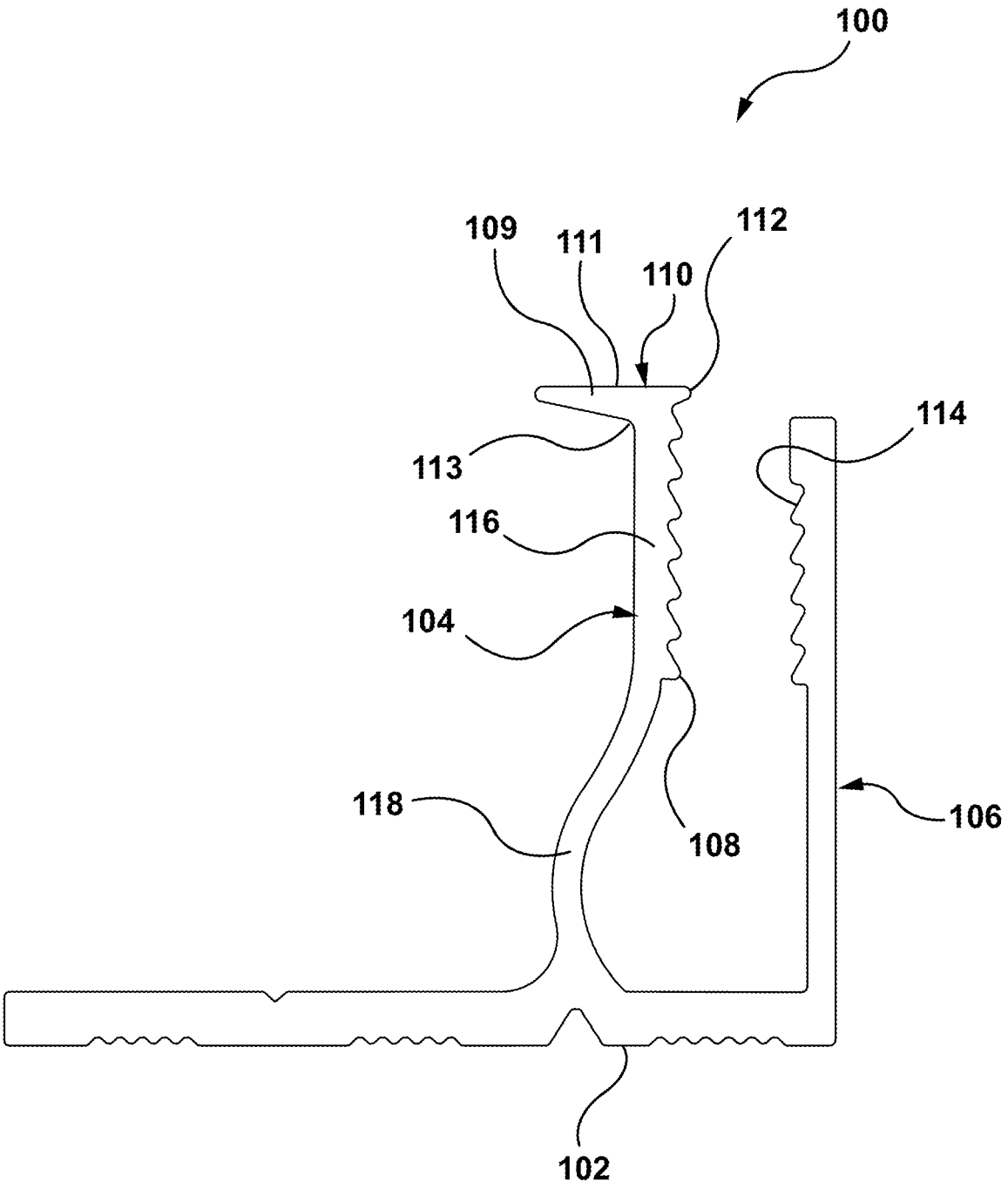
FIG. 1A is a side elevation view of a first illustrative extrusion profile bracket.
Figure 1B:
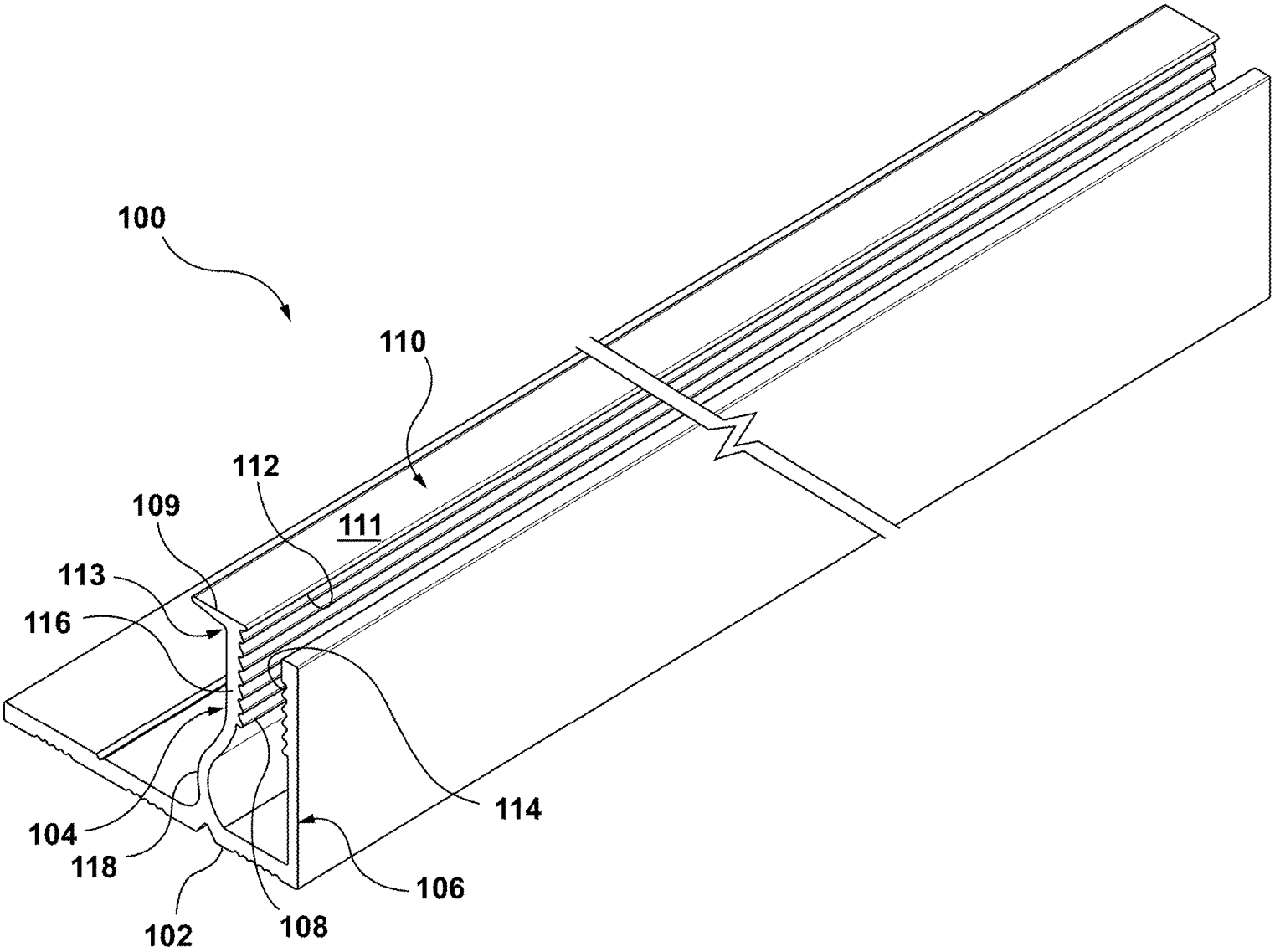
FIG. 1B is a first isometric view of the extrusion profile bracket of FIG. 1.
Figure 1C:
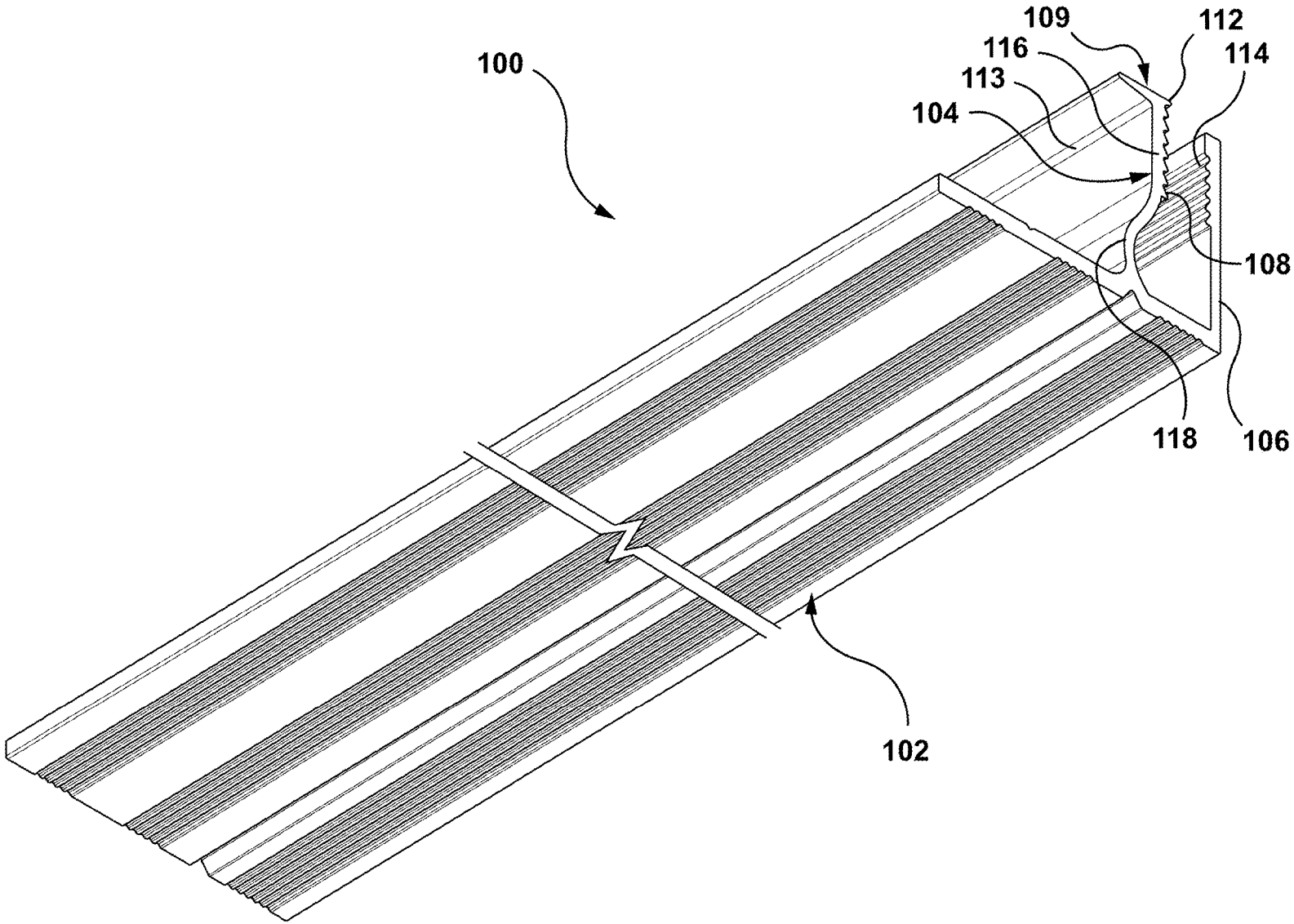
FIG. 1C is a second isometric view of the extrusion profile bracket of FIG. 1.

Reference is now made to FIGS. 1A, 1B and 1C, in which an illustrative embodiment of a first extrusion profile bracket is indicated generally at reference 100. The extrusion profile bracket 100 may be used for mounting panels to a wall, ceiling, or other structural surface.

The extrusion profile bracket 100 has a mounting base 102 and a first support leg 104 extending from the mounting base 102. A brace 106 also extends from the mounting base 102 and is spaced apart from the first support leg 104. The distance between the brace 106 and the first support leg 104 will depend upon the thickness of the panel to be mounted.

As shown in FIGS. 1A, 1B and 1C, in the illustrated embodiment the first support leg 104 is longer than the brace 106, that is, the first support leg 104 extends further from the mounting base 102 than does the brace 106.

The first support leg 104 has a plurality of first support leg panel gripping teeth 108 extending from the first support leg 104 toward the brace 106. The panel gripping teeth 108 may take a wide range of shapes and configurations. There may also be more gripping teeth than shown or fewer. The brace 106 has a plurality of brace first panel gripping teeth 114 extending toward the first support leg panel gripping teeth 108. Thus, the first support leg panel gripping teeth 108 and the brace first panel gripping teeth 114 extend toward one another.

The first support leg 104 terminates in a first support foot 110. The first support foot 110 has a forefoot portion 109 extending away from the brace 106 and a first locking heel 112 that extends toward the brace 106 and extends beyond the termini of the first support leg panel gripping teeth 108. In the illustrated embodiment, the first locking heel 112 extends at a substantially straight angle (about 180°) relative to the forefoot portion 109 (i.e. the first locking heel 112 and the forefoot portion 109 extend in opposite directions). Also in the illustrated embodiment, the first support foot 110 includes a generally planar sole surface 111 that extends along both the forefoot portion 109 and the first locking heel 112). The sole surface 111 will, as shown, for example, in FIGS. 2A, 2B and 3, fit flush with an interior surface of a panel (e.g. first panel 10 in FIGS. 2A, 2B and 3) received by the extrusion profile bracket 100. The support foot can, however, take on any shape so long as the first locking heel 112 extends beyond termini of the first support leg panel gripping teeth 108; this will enable the first locking heel 112 to interengage with the panel being received (e.g. first panel 10) as described further below. The first support foot 110 is joined at an ankle 113 to a first calf portion 116 of the first support leg 104, and a first curved thigh portion 118 of the first support leg 104 extends between the first calf portion 116 and the mounting base 102. The first calf portion 116 carries the first support leg panel gripping teeth 108, and the first curved thigh portion 118 of the first support leg 104 has a concave curvature facing the brace 106. The curvature of the first thigh portion 118 provides a resilient bias of the first calf portion 116 toward the brace 106 and provides flexibility when inserting a panel.

The first support leg panel gripping teeth 108 and the brace first panel gripping teeth 114 are arranged in registration with, and in opposition to, one another. In the embodiment shown in FIGS. 1A, 1B and 1C, for example, the brace first panel gripping teeth 114 extend only along a portion of the brace 106 that is substantially in registration with the first calf portion 116 of the first support leg 104, which in turn carries the first support leg panel gripping teeth 108. Preferably, the first support leg panel gripping teeth 108 and the brace first panel gripping teeth 114 are longitudinally co-extensive along an extrusion direction of the extrusion profile bracket 100, although they may have different longitudinal extents.

Figure 2A:
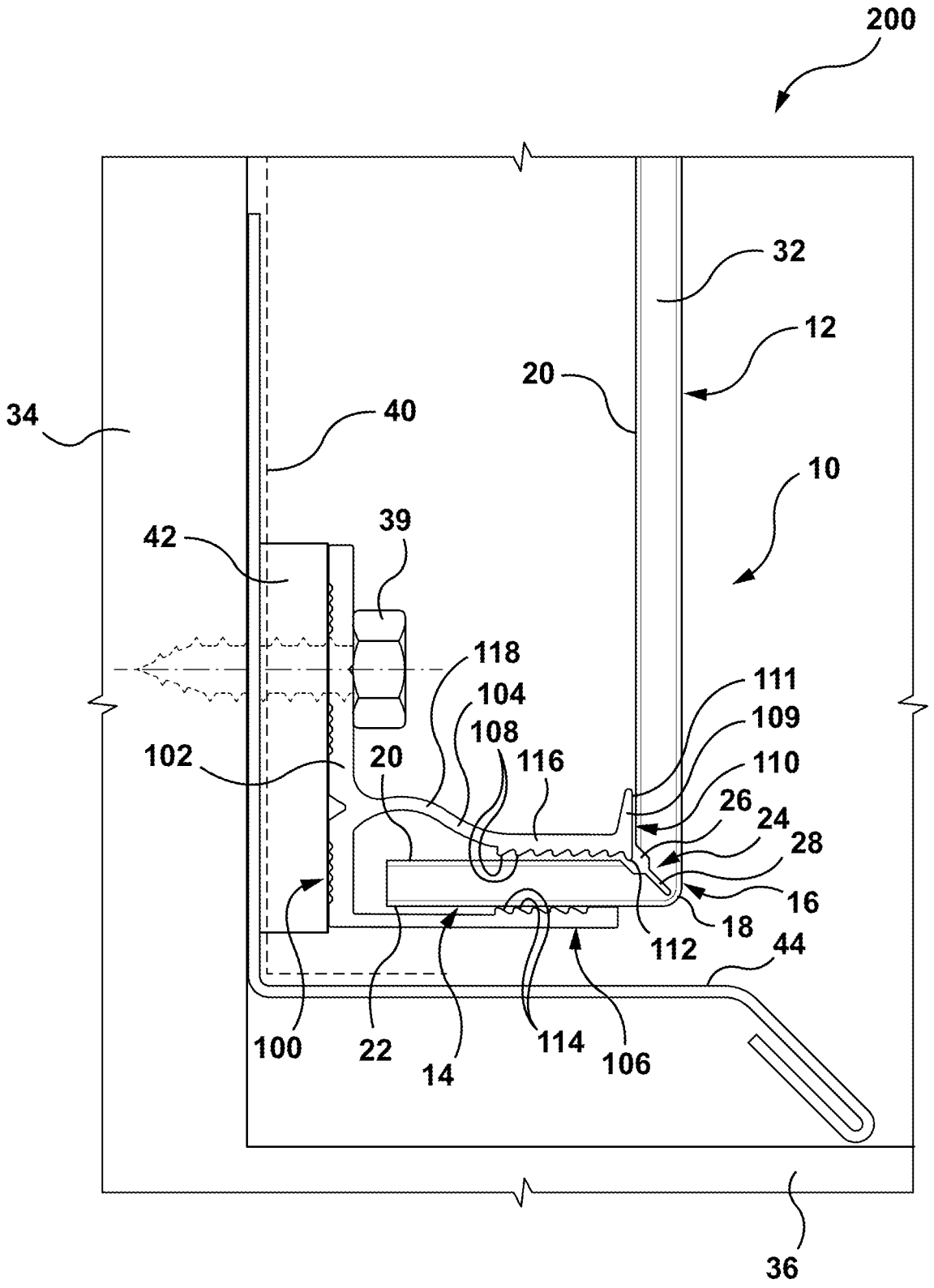
FIG. 2A is a side elevation view showing use of the extrusion profile bracket of FIG. 1 to mount a first panel on a wall adjacent the ground or a similar surface.
Figure 2B:
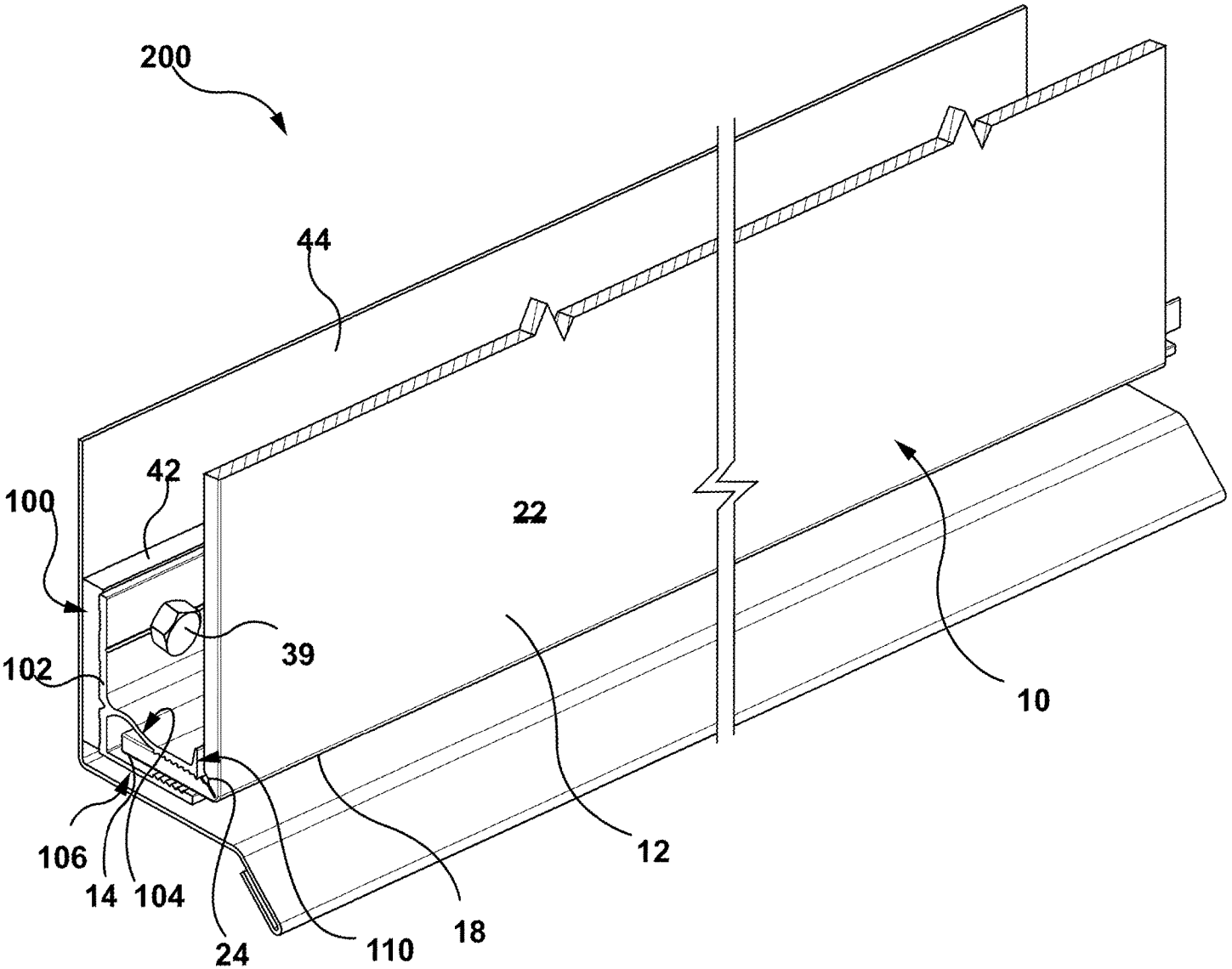
FIG. 2B is an isometric view showing use of the extrusion profile bracket of FIG. 1 to mount a first panel on a wall adjacent the ground or a similar surface.

One or more instances of the first extrusion profile bracket 100 may form part of a composite panel system. Turning now to FIGS. 2A and 2B, a first illustrative composite panel system is indicated generally at reference 200. The first composite panel system 200 comprises at least one extrusion profile bracket 100, and at least a first panel 10. The first panel 10 has a first panel facing 12 and a first panel mounting flange 14 that depends generally orthogonally from an end 16 of the first panel facing 12 to form a first panel corner 18 between the first panel facing 12 and the first panel mounting flange 14. The first panel 10 has a first panel inner surface 20 facing toward the first support leg 104 and a first panel outer surface 22 facing away from the first support leg 104. The first panel 10 is preferably a composite panel, in which the first panel inner surface 20 and the first panel outer surface 22 are formed by respective first panel metal layers and a first panel intermediate layer of filler 32 (or "core") is disposed between the first panel metal layers. The first panel metal layers are preferably aluminum, although other suitable metals may be used. The first panel intermediate layer of filler 32 may be plastic (e.g. LDPE), foam, mineral, composite, or any other suitable material as will be known to one with skill in the art. The first panel may also be a solid metal panel, or a solid panel of another suitable material. The first panel 10 has a first panel notch 24 formed in the first panel inner surface 20 at the first panel corner 18. In the illustrated embodiment, the first panel notch 24 extends entirely through the first panel metal layer that forms the first panel inner surface 20 and into the first panel intermediate layer of filler 32. The notch 24 may facilitate folding of the first panel 10 to form the first panel corner 18.

Figure 3:
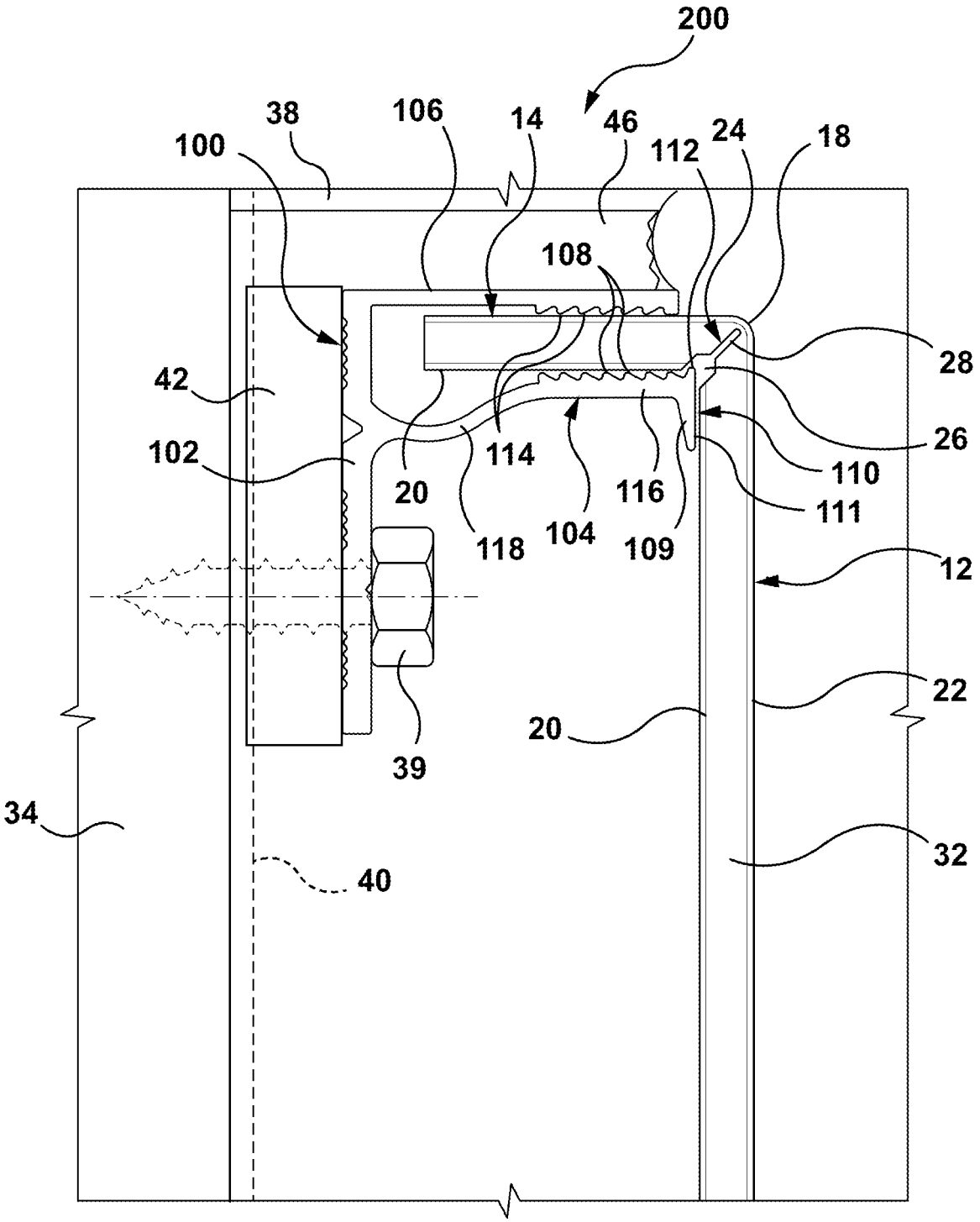
FIG. 3 is a side elevation view showing use of the extrusion profile bracket of FIG. 1 to mount a first panel on a wall adjacent a ceiling or a similar surface.

Mounting of the first panel 10 on a wall 34 or similar structure using the first extrusion profile bracket 100 will now be described with respect to FIGS. 2A, 2B and 3. FIGS. 2A and 2B show detail of a base mounting for the first panel 10, for example adjacent the ground 36 or a similar surface, and FIG. 3 shows detail of an end wall mounting for the first panel 10, for example adjacent a ceiling 38 or similar surface. In each case, the extrusion profile bracket 100 is secured to the wall 34 by way of a screw 39 or other suitable fastener passing through a corresponding aperture in the mounting base 102 into the wall 34. An air-vapor barrier ("a/v barrier") 40 is optionally interposed between the extrusion profile bracket 100 and the wall 34 in known manner, with a shim 42 interposed between the extrusion profile bracket 100 and the a/v barrier 40. For the base mounting shown in FIGS. 2A and 2B, a lower flashing 44 is mounted between the a/v barrier 40 and the wall 34 and extends out beyond the first panel outer surface 22. For the end wall mounting shown in FIG. 3, a line of caulking 46 may be applied between the brace 106 and the ceiling 38.

In both the base mounting in FIGS. 2A and 2B, and the end wall mounting in FIG. 3, the first panel mounting flange 14 is received between the first support leg 104 and the brace 106 and gripped by the first support leg panel gripping teeth 108 and the brace first panel gripping teeth 114. The first support foot 110 abuts the first panel facing 12 on the first panel inner surface 20. The first locking heel 112 extends into the first panel notch 24 to form an interference fit with the first panel mounting flange 14 to obstruct withdrawal of the first panel mounting flange 14 from between the first support leg 104 and the brace 106. As noted above, the curvature of the first thigh portion 118 provides a resilient bias of the first calf portion 116 toward the brace 106, and in a preferred embodiment, the first panel mounting flange 14 is slightly thicker than the space between the first support leg panel gripping teeth 108 and the brace first panel gripping teeth 114. Thus, when the first panel mounting flange 14 is received between the first support leg 104 and the brace 106, the resilient bias of the first calf portion 116 toward the brace 106 assists in clamping the first panel mounting flange 14 between the first support leg panel gripping teeth 108 and the brace first panel gripping teeth 114. In the illustrated embodiment, the first panel notch 24 has a wider entry mouth 26 tapering toward a narrower slot 28. The first panel notch 24, therefore, provides for an interference fit for the first locking heel 112. The slot 28 of the first panel notch 24 may provide for flexion of the first panel 10 at the first panel corner 18.

Figure 4:
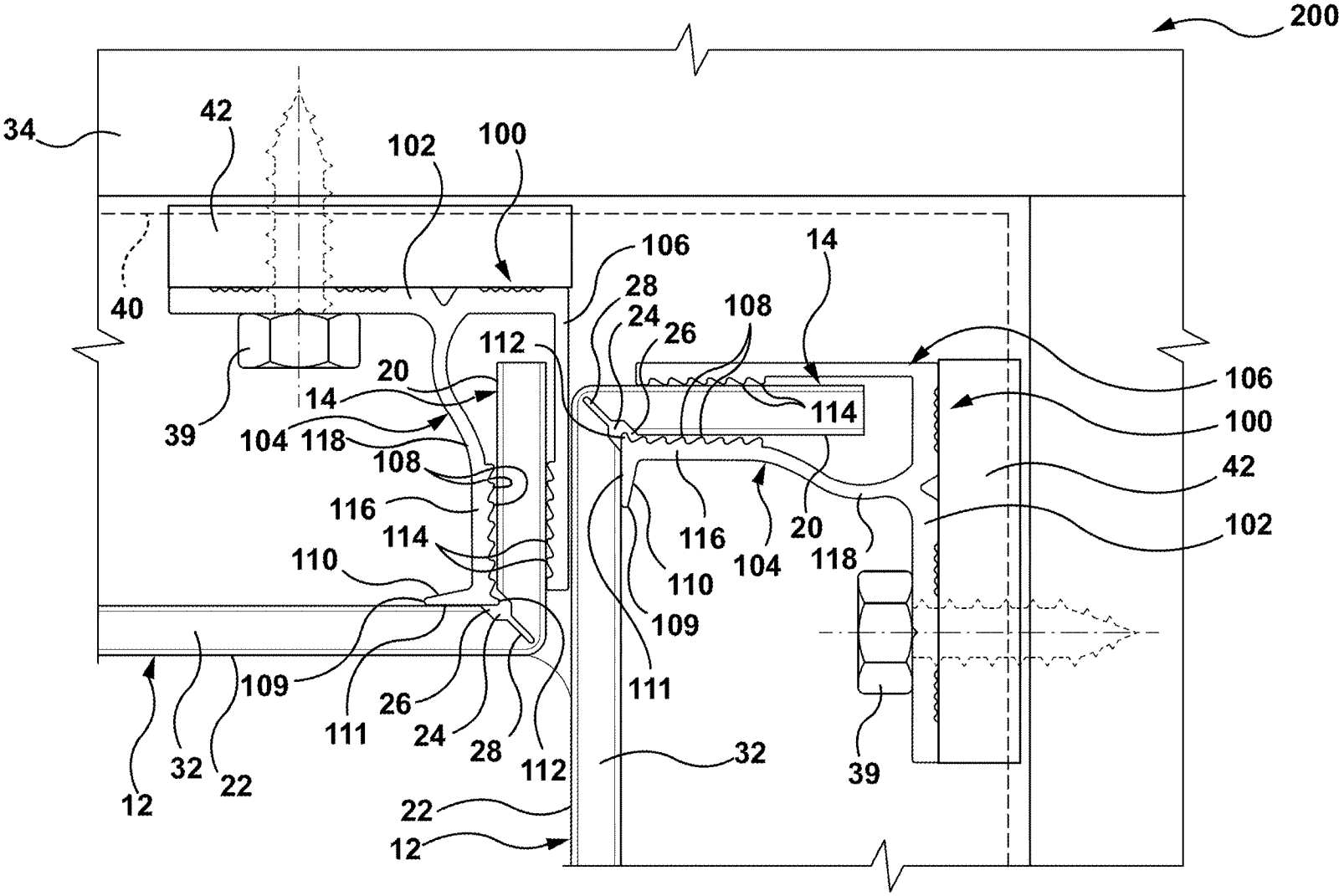
FIG. 4 shows an inside corner mounting formed by arranging two instances of the mounting shown in FIG. 3 in abutment.

FIG. 4 shows an inside corner mounting formed by arranging two instances of the end wall mounting shown in FIG. 3 in abutment so that the respective first panel facings 12 are orthogonal to one another; a further line of caulking 48 may be applied at a junction between the first panel outer surfaces 22.

Figure 5:
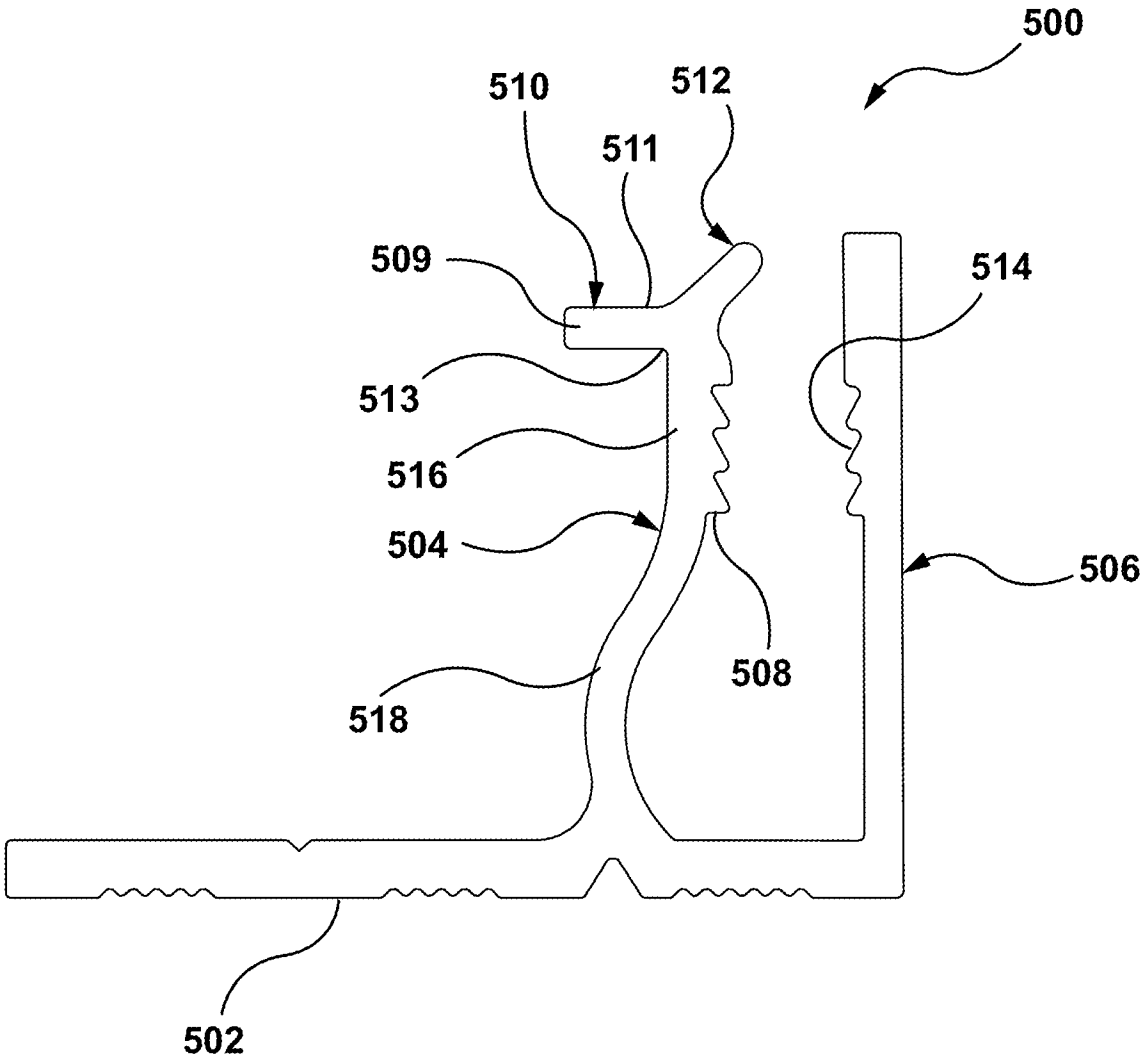
FIG. 5 is a side elevation view of a second illustrative extrusion profile bracket.

Reference is now made to FIG. 5, in which an illustrative embodiment of a second extrusion profile bracket is indicated generally at reference 500. The second extrusion profile bracket 500 shown in FIG. 5 is similar to the first extrusion profile bracket 100 shown in FIG. 1, with like references denoting like features but with the prefix "5" instead of "1". The second extrusion profile bracket 500 shown in FIG. 5 differs from the first extrusion profile bracket 100 shown in FIG. 1 in that for the second extrusion profile bracket 500, the brace 506 is longer than the first support leg 504, that is, the brace 506 extends further from the mounting base 102 than does the first support leg 504. Additionally, for the second extrusion profile bracket 500, instead of extending at a straight angle, the first locking heel 512 is arranged at an obtuse angle relative to the forefoot portion 509 such that the first locking heel 512 extends beyond the termini of the first support leg panel gripping teeth 508 toward the brace 506 and also extends away from the mounting base 502. The generally planar sole surface 511 extends only along the forefoot portion 509.

Figure 6:
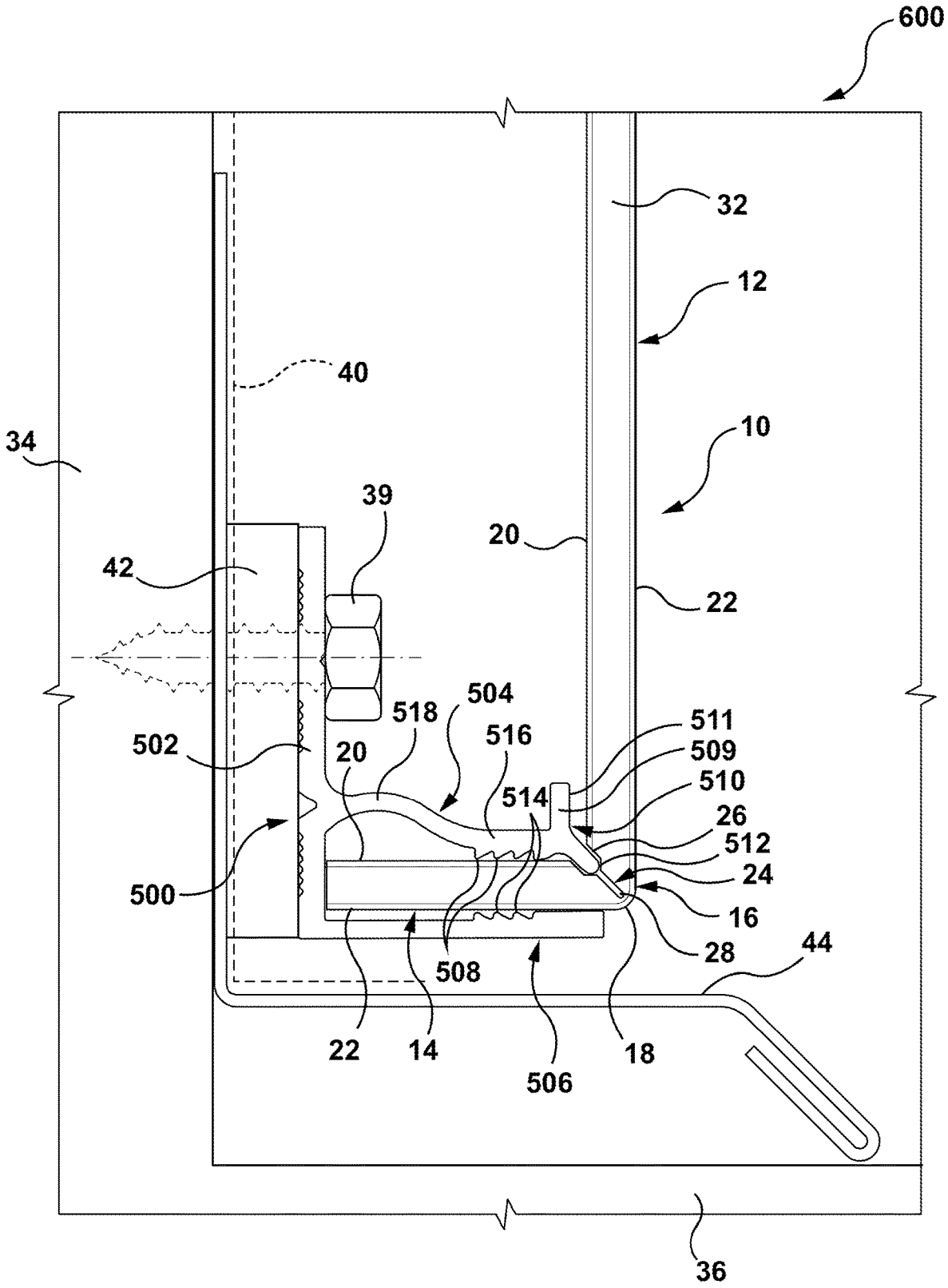
FIG. 6 is a side elevation view showing use of the extrusion profile bracket of FIG. 5 to mount a first panel on a wall adjacent the ground or a similar surface.
Figure 7:
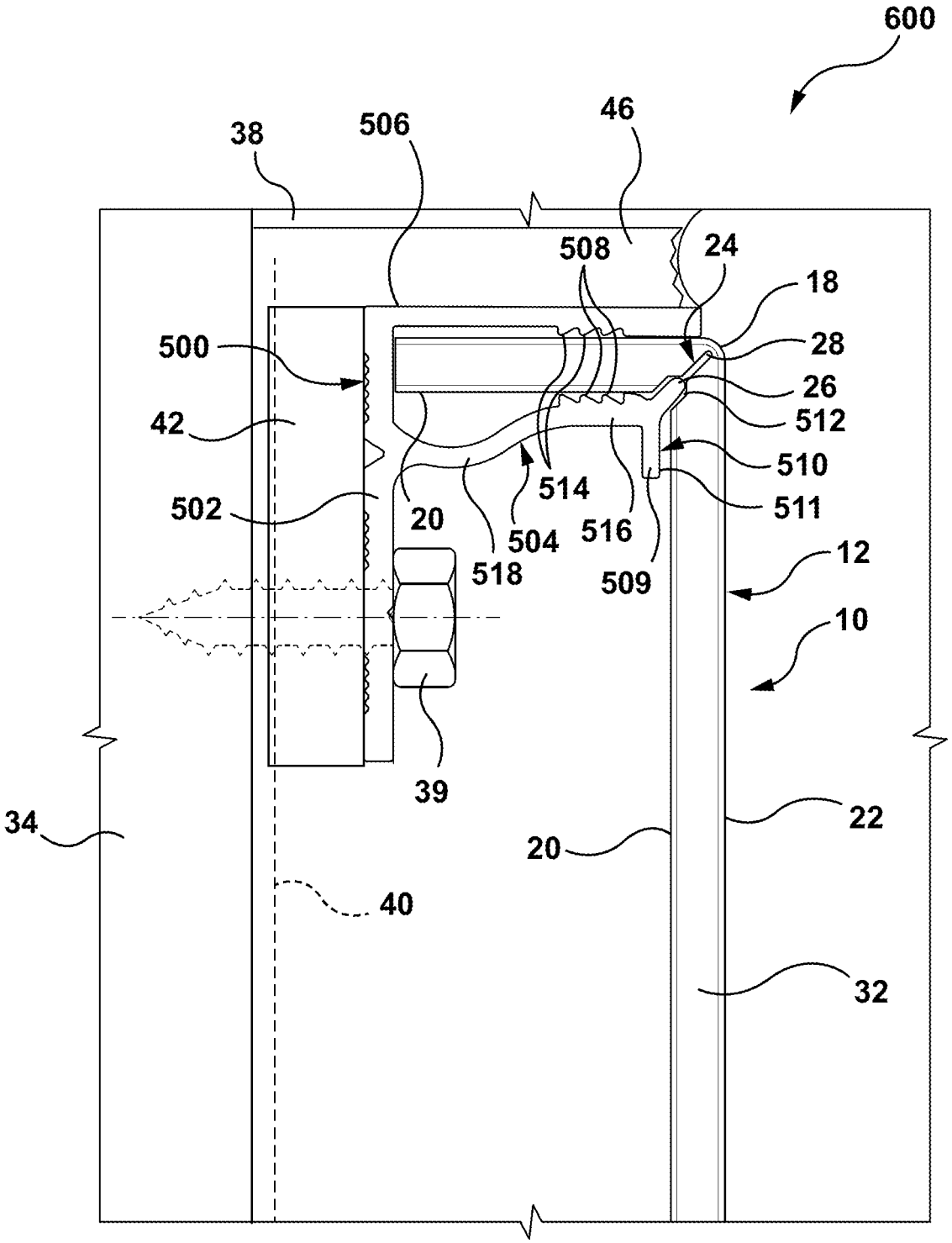
FIG. 7 is a side elevation view showing use of the extrusion profile bracket of FIG. 5 to mount a first panel on a wall adjacent a ceiling or a similar surface.

The second extrusion profile bracket 500 may form part of a second illustrative composite panel system, indicated generally at reference 600. The second composite panel system 600 comprises at least one extrusion profile bracket 600, and at least a first panel 10. Mounting of the first panel 10 using the second extrusion profile bracket 500 is shown in FIGS. 6 and 7, and is similar to that for the first extrusion profile bracket 100. The first locking heel 512 extends into the first panel notch 24 to form an interference fit with the first panel mounting flange 14 to obstruct withdrawal of the first panel mounting flange 14 from between the first support leg 504 and the brace 506. FIG. 6 shows detail of a base mounting for the first panel 10, for example adjacent the ground 36 or a similar surface, and FIG. 7 shows detail of an end wall mounting for the first panel 10, for example adjacent a ceiling 38 or similar surface. In the base mounting shown in FIG. 6, the first support foot 510 is spaced from the first panel facing 12 on the first panel inner surface 20, and in FIG. 7, the first support foot 510 abuts the first panel facing 12 on the first panel inner surface 20.

Figure 8:
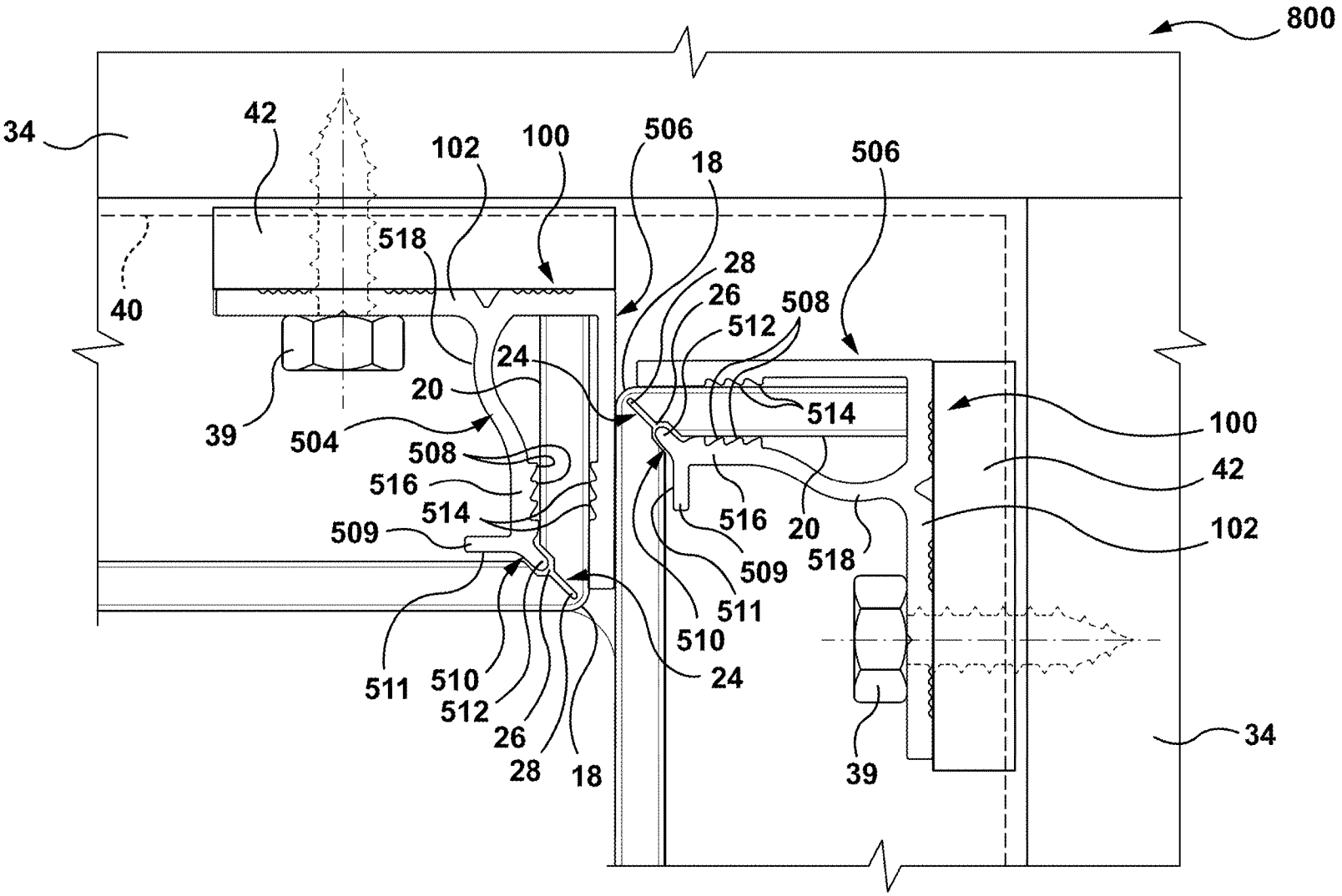
FIG. 8 shows an inside corner mounting formed by arranging two instances of the mounting shown in FIG. 7 in abutment.

As shown in FIG. 8, an inside corner mounting 800 may be formed by arranging two instances of the end wall mounting shown in FIG. 7 in abutment, similar to the arrangement shown in FIG. 4.

Figure 9A:
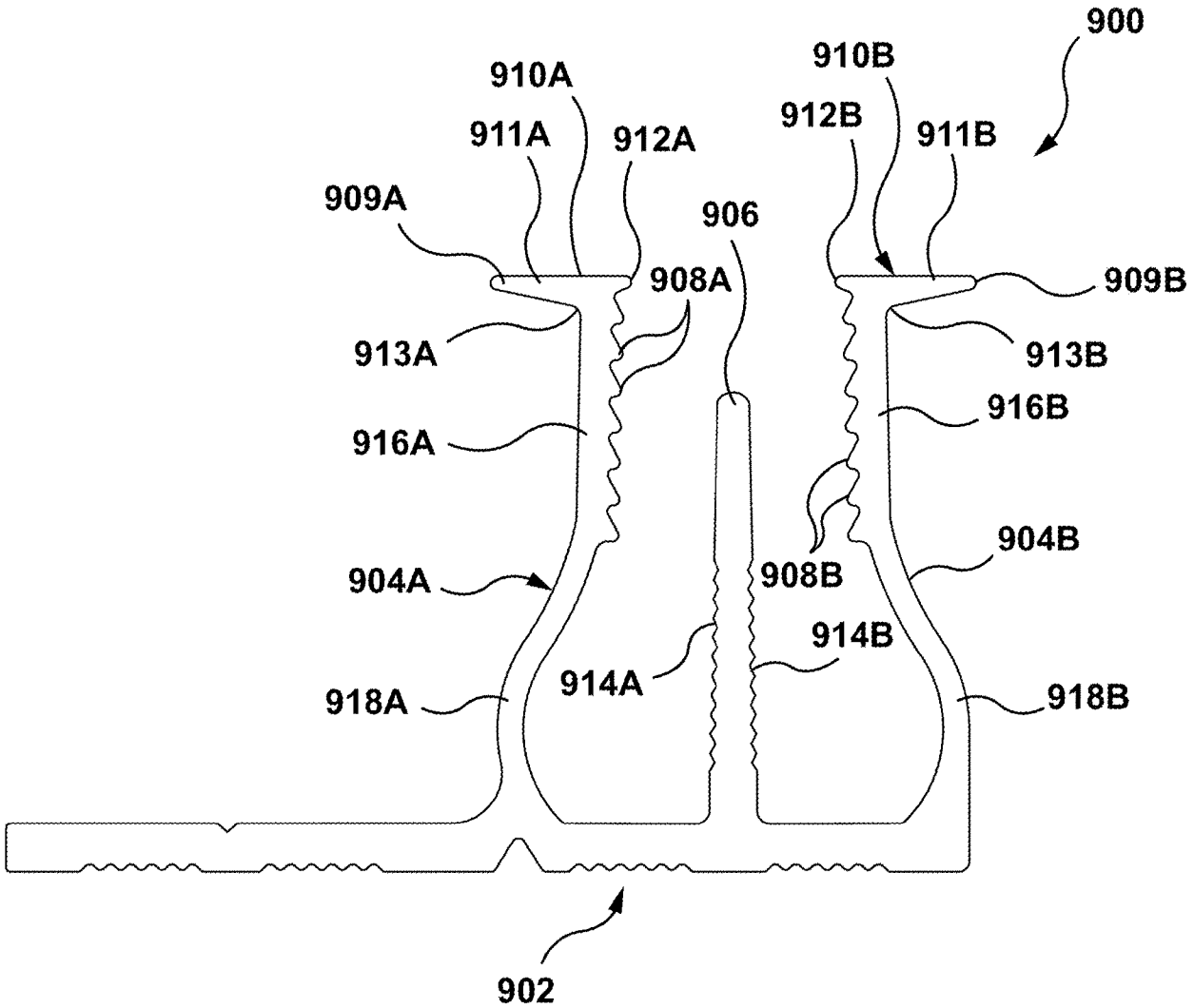
FIG. 9A is a side elevation view of a third illustrative extrusion profile bracket.
Figure 9B:
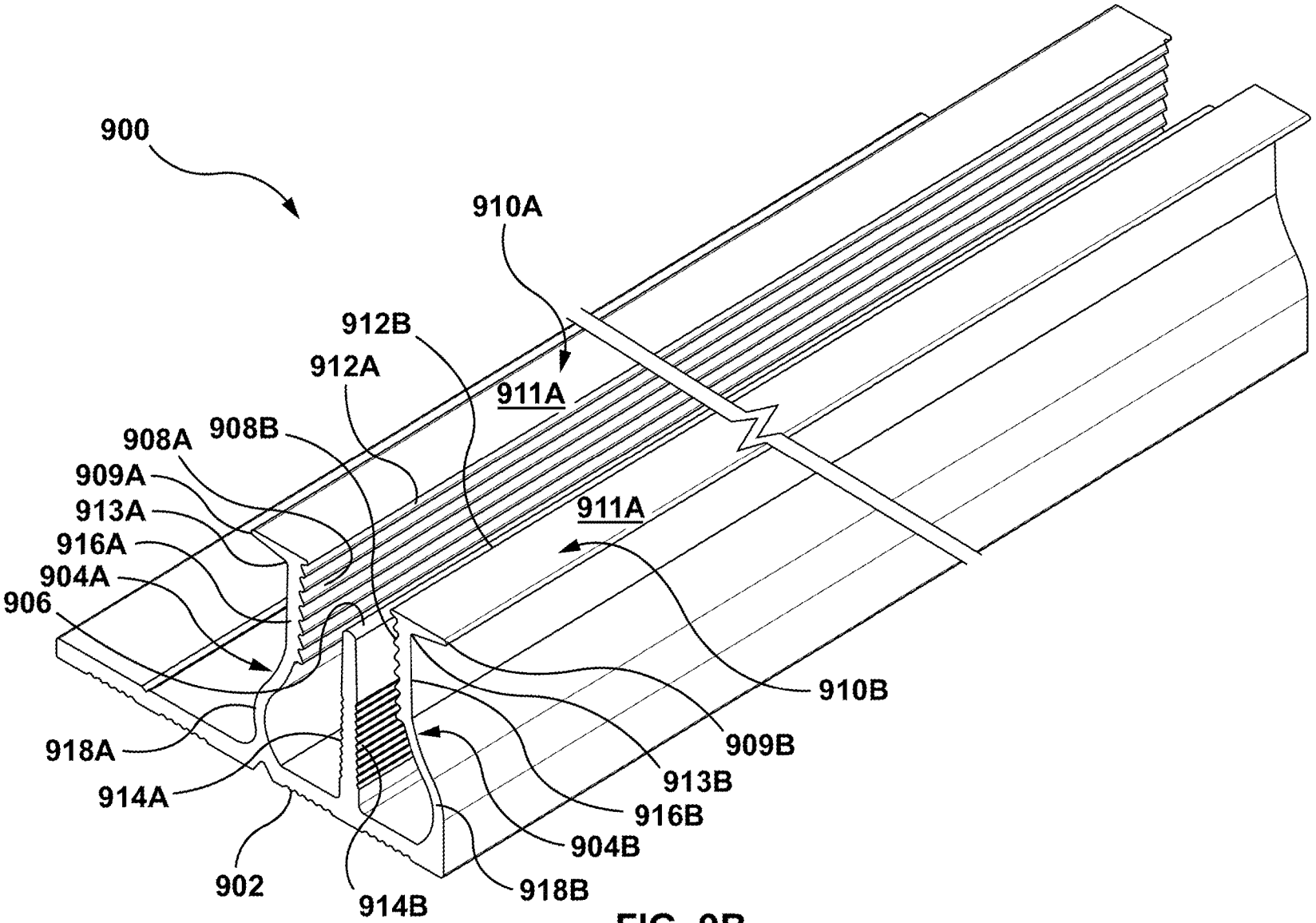
FIG. 9B is a first isometric view of the extrusion profile bracket of FIG. 8A.
Figure 9C:
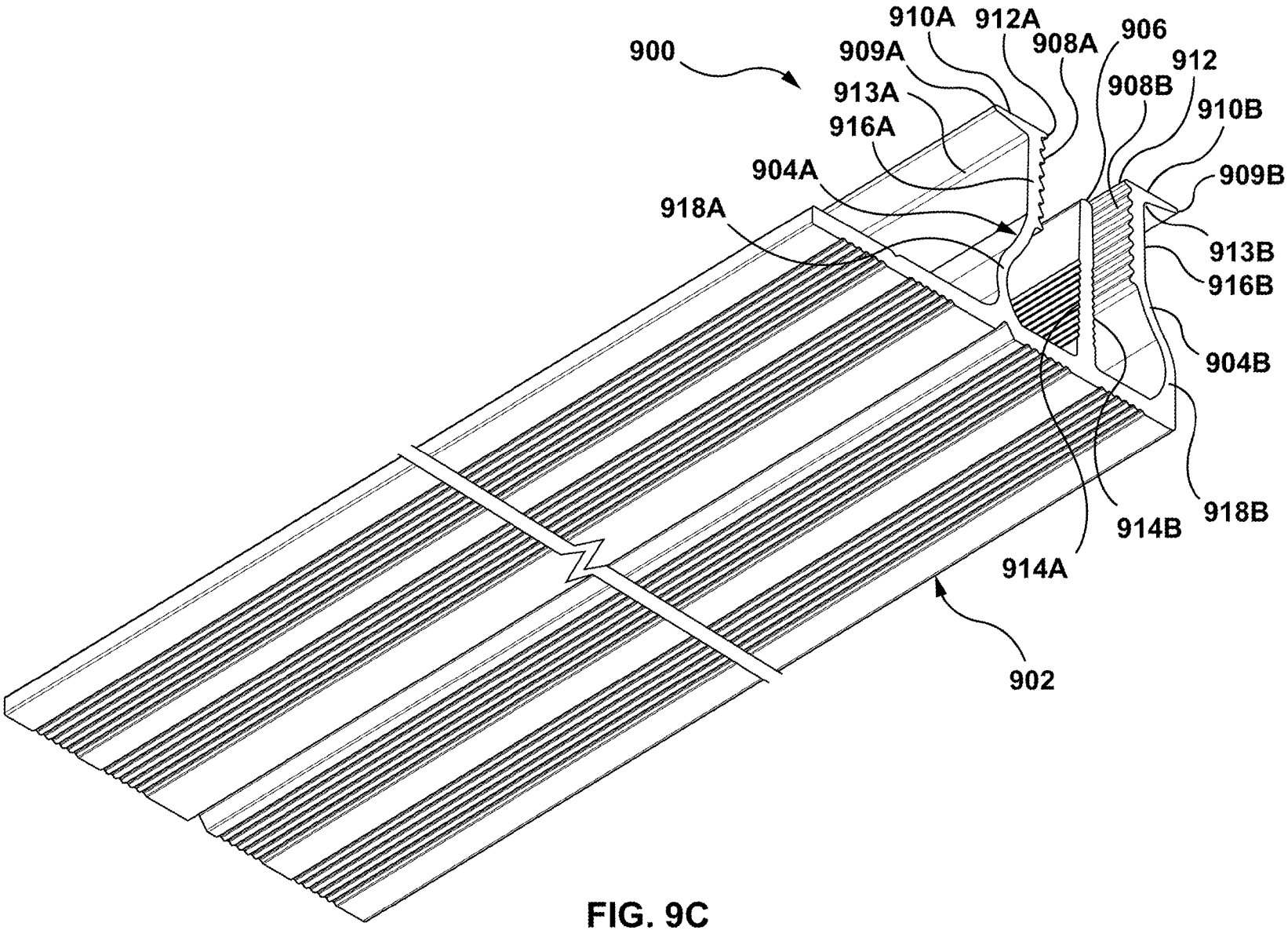
FIG. 9C is a second isometric view of the extrusion profile bracket of FIG. 8A.

Reference is now made to FIGS. 9A to 9C, in which an illustrative embodiment of a third extrusion profile bracket is indicated generally at reference 900. The third extrusion profile bracket 900 includes a first support leg and a brace as well as a second support leg, and may be conceptualized as comprising the first extrusion profile bracket 100 with a second support leg provided on the opposite side of the brace from the first support leg. Thus like reference numerals will denote corresponding features, except with the prefix "9" instead of "1" and the suffix "A" or "B" where appropriate.

More particularly, the third extrusion profile bracket 900 comprises a mounting base 902, a first support leg 904A extending from the mounting base 902, a brace 906 extending from the mounting base 902, and a second support leg 904B extending from the mounting base 902 on the opposite side of the brace 906 from the first support leg 904A. Both the first support leg 904A and the second support leg 904B are spaced apart from the brace 906; the spacing will depend upon the thickness of the panel(s) to be mounted. The brace 906 is disposed between the first support leg 904A and the second support leg 904B. As shown in FIG. 9, in the illustrated embodiment the support legs 904A, 904B extend further from the mounting base 902 than does the brace 906 although other configurations are also contemplated.

The first support leg 904A has a plurality of first support leg panel gripping teeth 908A extending from the first support leg 904A toward the brace 906. The second support leg 904B similarly has a plurality of second support leg panel gripping teeth 908B extending from the second support leg 904B toward the brace 906. Thus, the first support leg panel gripping teeth 908A and the second support leg panel gripping teeth 908B extend toward one another. The brace 906 has a plurality of brace first panel gripping teeth 914A extending toward the first support leg panel gripping teeth 908A and a second plurality of brace second panel gripping teeth 914B that extends toward the second support leg panel gripping teeth 908B. Thus, the first support leg panel gripping teeth 908A and the brace first panel gripping teeth 914A extend toward one another and the second support leg panel gripping teeth 908B and the brace second panel gripping teeth 914B similarly extend toward one another. Accordingly, the first support leg panel gripping teeth 908A and the brace first panel gripping teeth 914A are arranged in opposition to one another and the second support leg panel gripping teeth 908B and the brace second panel gripping teeth 914B are likewise arranged in opposition to one another. The brace first panel gripping teeth 914A are offset from the first support leg panel gripping teeth 908A and the brace second panel gripping teeth 914B are similarly offset from the second support leg panel gripping teeth 908B.

The support legs 904A, 904B terminate in respective support feet 910A, 910B. The first support foot 910A has a forefoot portion 909A extending away from the brace 906, oppositely to the first support leg panel gripping teeth 908A, and a first locking heel 912A extending toward the brace 906 and beyond the termini of the first support leg panel gripping teeth 908A. Similarly, the second support foot 910B has a forefoot portion 909B extending away from the brace 906, oppositely to the second support leg panel gripping teeth 908B, and a second locking heel 912B that extends toward the brace 906 and extends beyond the termini of the second support leg panel gripping teeth 908B. In the illustrated embodiment the locking heels 912A, 912B each extend at a substantially straight angle (about 180°) relative to the respective forefoot portions 909A, 909B and the support feet 910A, 910B each include a respective generally planar sole surface 911A, 911B extending along both the forefoot portion 909A, 909B and the locking heel 912A, 912B. The support feet 910A, 910B can, however, take on any shape so long as the locking heels 912A, 912B extend beyond the termini of the support leg panel gripping teeth 908A, 908B.

The first support foot 910A is joined at an ankle 913A to a generally planar first calf portion 916A of the first support leg 904A, and a first curved thigh portion 918A of the first support leg 904A extends between the first calf portion 916A and the mounting base 902. Similarly, the second support foot 910B is joined at an ankle 913B to a generally planar second calf portion 916B of the second support leg 904B, and a second curved thigh portion 918B of the second support leg 904B extends between the second calf portion 916B and the mounting base 902. The first calf portion 916A of the first support leg 904A carries the first support leg panel gripping teeth 908A and the second calf portion 916B of the second support leg 904B carries the second support leg panel gripping teeth 908B. The curved thigh portions 918A, 918B each have a concave curvature facing the brace 906, which provides a resilient bias of the respective calf portions 916A, 916B toward the brace 906.

Variations in the shape, number and configuration of the panel gripping teeth 908A, 908B, 914A, 914B, and in the shape and configuration of the support feet 910A, 910B and/or the locking heels 912A, 912B, are contemplated. While the support legs 904A, 904B are shown as generally symmetrical, this is merely one illustrative embodiment and other configurations are also contemplated. For example, the second support leg may have teeth of different shape and/or placement, or a curvature that is different from the first such that the two support legs are not symmetrical around the brace. Moreover, the brace itself may be asymmetrical.

Figure 10A:
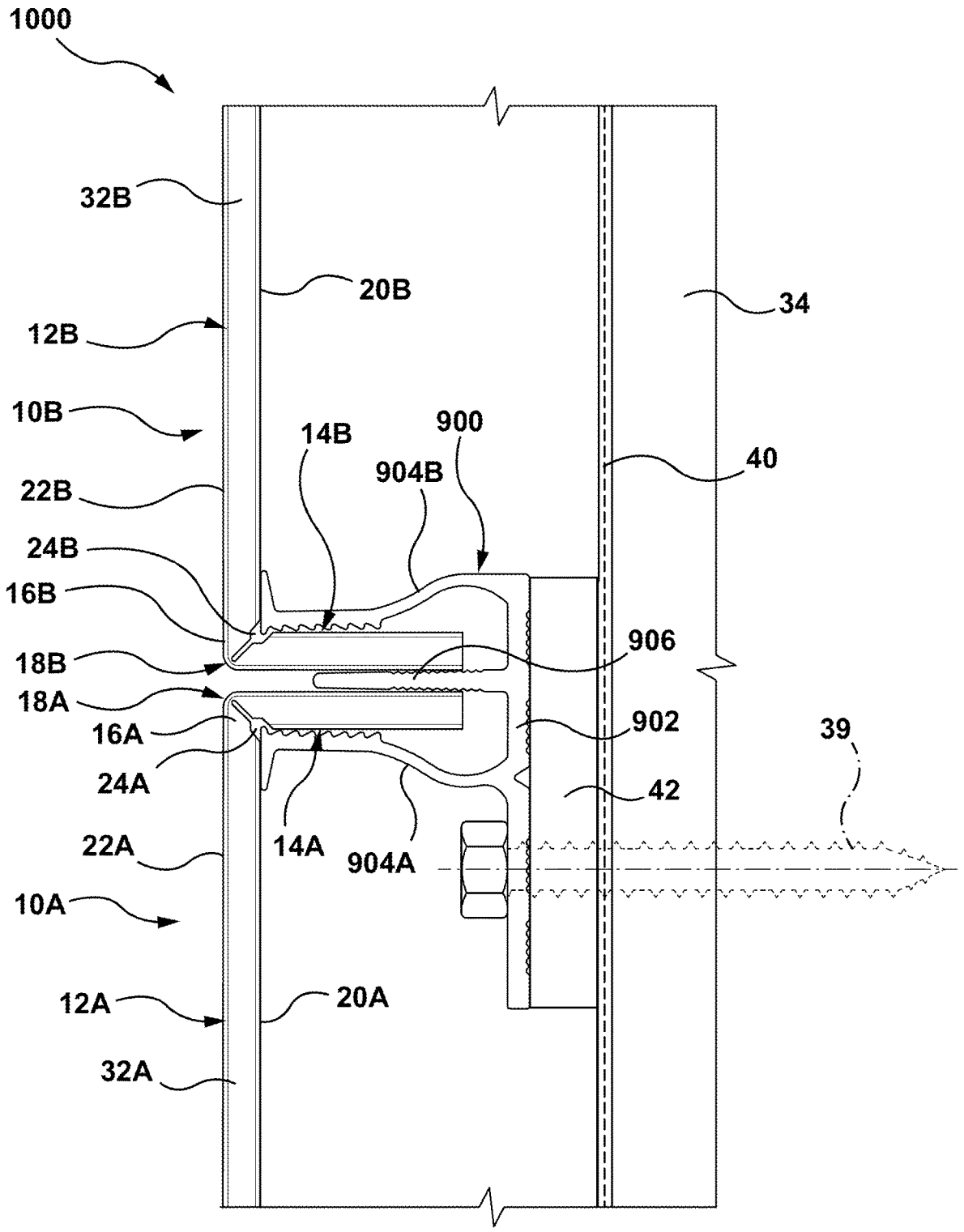
FIG. 10A shows a vertical joint mounting for two panels using the extrusion profile bracket of FIG. 9.
Figure 10B:
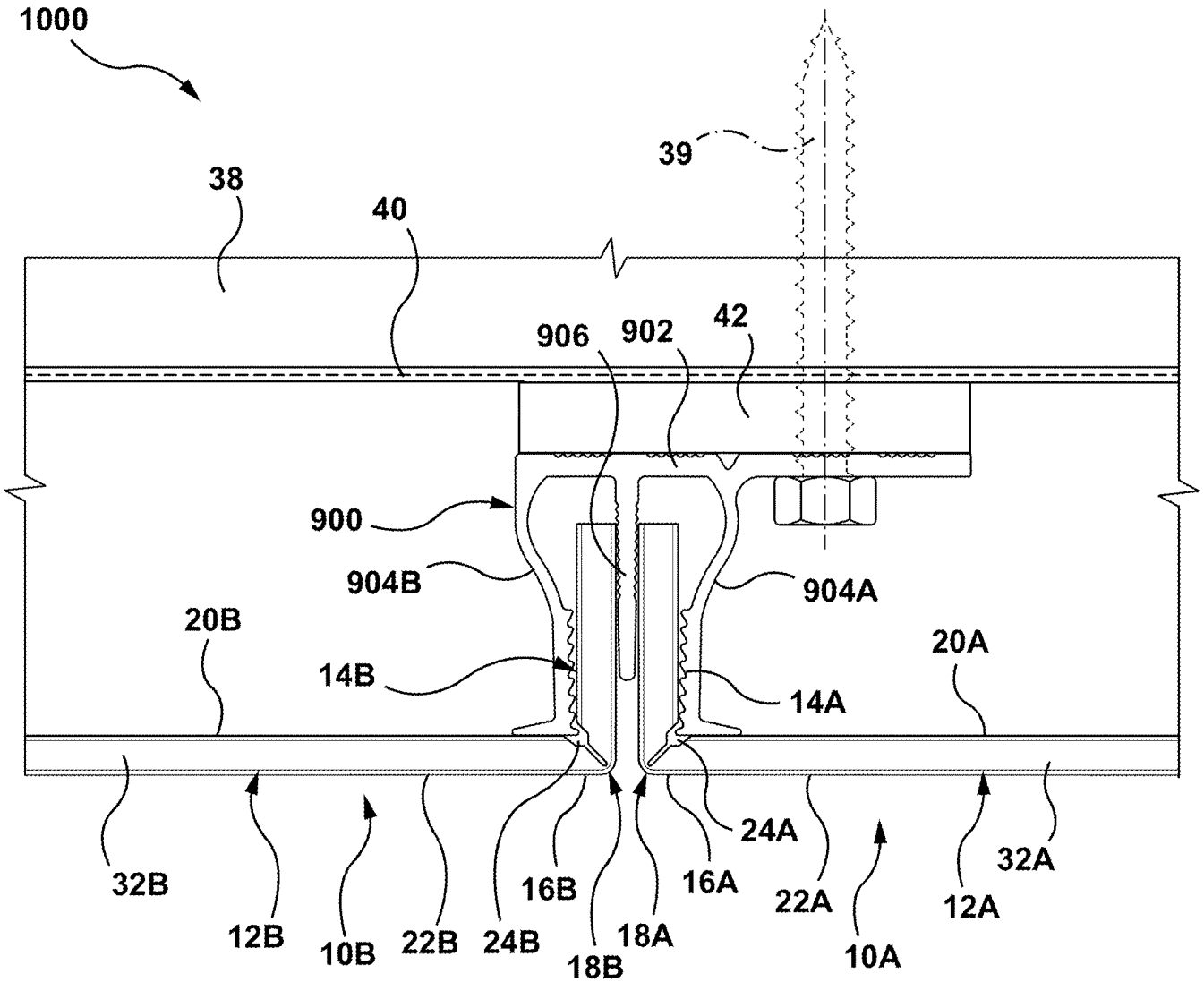
FIG. 10B shows a horizontal joint mounting for two panels using the extrusion profile bracket of FIG. 9.

One or more instances of the third extrusion profile bracket 900 may form part of a third illustrative composite panel system, indicated generally by reference 1000 in FIGS. 10A and 10B. More particularly, the third extrusion profile bracket 900 may serve to join adjacent panels to one another. The third composite panel system 1000 comprises at least one instance of the third extrusion profile bracket 900, a first panel 10A and a second panel 10B. The panels 10A, 10B are composite panels of similar construction to the panel 10 described above, with like reference numerals denoting like features except with the suffix "A" for the first panel 10A and "B" for the second panel 10B.

FIG. 10A shows a vertical joint mounting for the panels 10A, 10B, for example on a wall 34, and FIG. 10B shows a horizontal joint mounting for the panels 10A, 10B, for example adjacent a ceiling 38 or similar surface. In each case, the third extrusion profile bracket 900 is secured by way of a screw 39 or other suitable fastener passing through a corresponding aperture in the mounting base 902 into the wall 34 or ceiling 38. An air-vapor barrier ("a/v barrier") 40 is optionally interposed between the third extrusion profile bracket 900 and the wall 34 or ceiling 38 in known manner, with a shim 42 interposed between the third extrusion profile bracket 900 and the a/v barrier 40.

In both the vertical joint mounting in FIG. 10A and the horizontal joint mounting in FIG. 10B, the first panel mounting flange 14A is received between the first support leg 904A and the brace 906 and gripped by the first support leg panel gripping teeth 908A and the brace first panel gripping teeth 914A. The first support foot 910A abuts the first panel facing 12A on the first panel inner surface 20A and the first locking heel 912A extends into the first panel notch 24A to form an interference fit with the first panel mounting flange 14A. This interference fit will obstruct withdrawal of the first panel mounting flange 14A from between the first support leg 904A and the brace 906. Similarly, the second panel mounting flange 14B is received between the second support leg 904B and the brace 906 and is gripped by the second support leg panel gripping teeth 908B and the brace second panel gripping teeth 914B. The second support foot 910B abuts the second panel facing 12B on the second panel inner surface 20B. The second locking heel 912B extends into the second panel notch 24B to obstruct withdrawal of the second panel mounting flange 14B from between the second support leg 904B and the brace 906. The curvature of the thigh portions 918A, 918B provides a resilient bias of the calf portions 916A, 916B toward the brace 906 (and toward one another). Each panel mounting flange 14A, 14B is preferably slightly thicker than the space between the respective support leg panel gripping teeth 908A, 908B and the brace panel gripping teeth 914A, 914B. The result is that the resilient bias of each calf portion 916A, 916B toward the brace 906 assists in clamping the respective panel mounting flange 14A, 14B between the respective opposed support leg panel gripping teeth 908A, 908B and the brace panel gripping teeth 914A, 914B. In some embodiments, the space between the first support leg panel gripping teeth 908A and the brace first panel gripping teeth 914A may be larger or smaller than the space between the second support leg panel gripping teeth 908B and the brace second panel gripping teeth 914B. In such an embodiment, the thickness of the panel mounting flanges 14A, 14B may correspondingly differ from one another. The panel notches 24A, 24B receive the respective locking heels 912A, 912B in an interference fit.

Figure 11A:
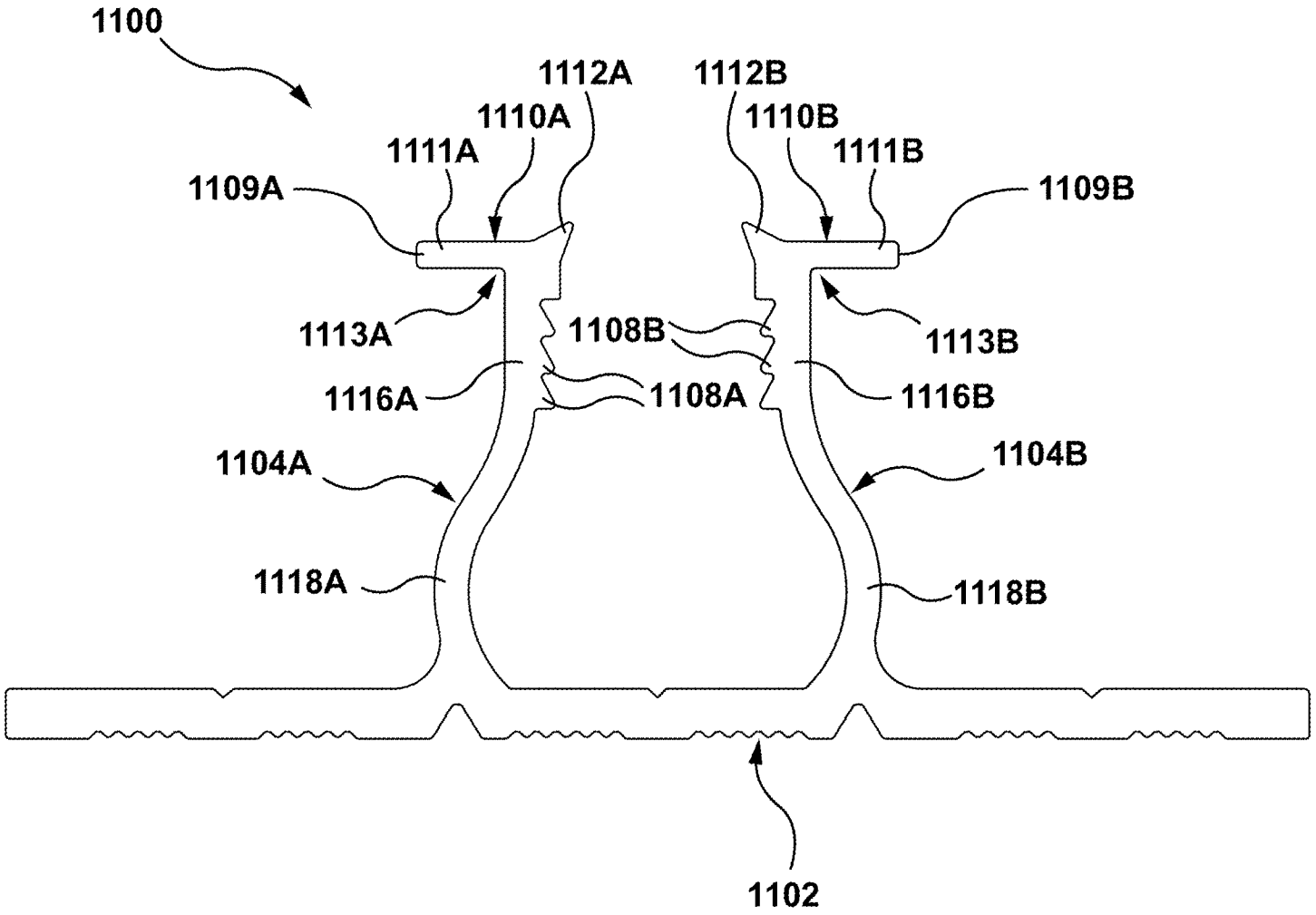
FIG. 11A is a side elevation view of a fourth illustrative extrusion profile bracket.
Figure 11B:
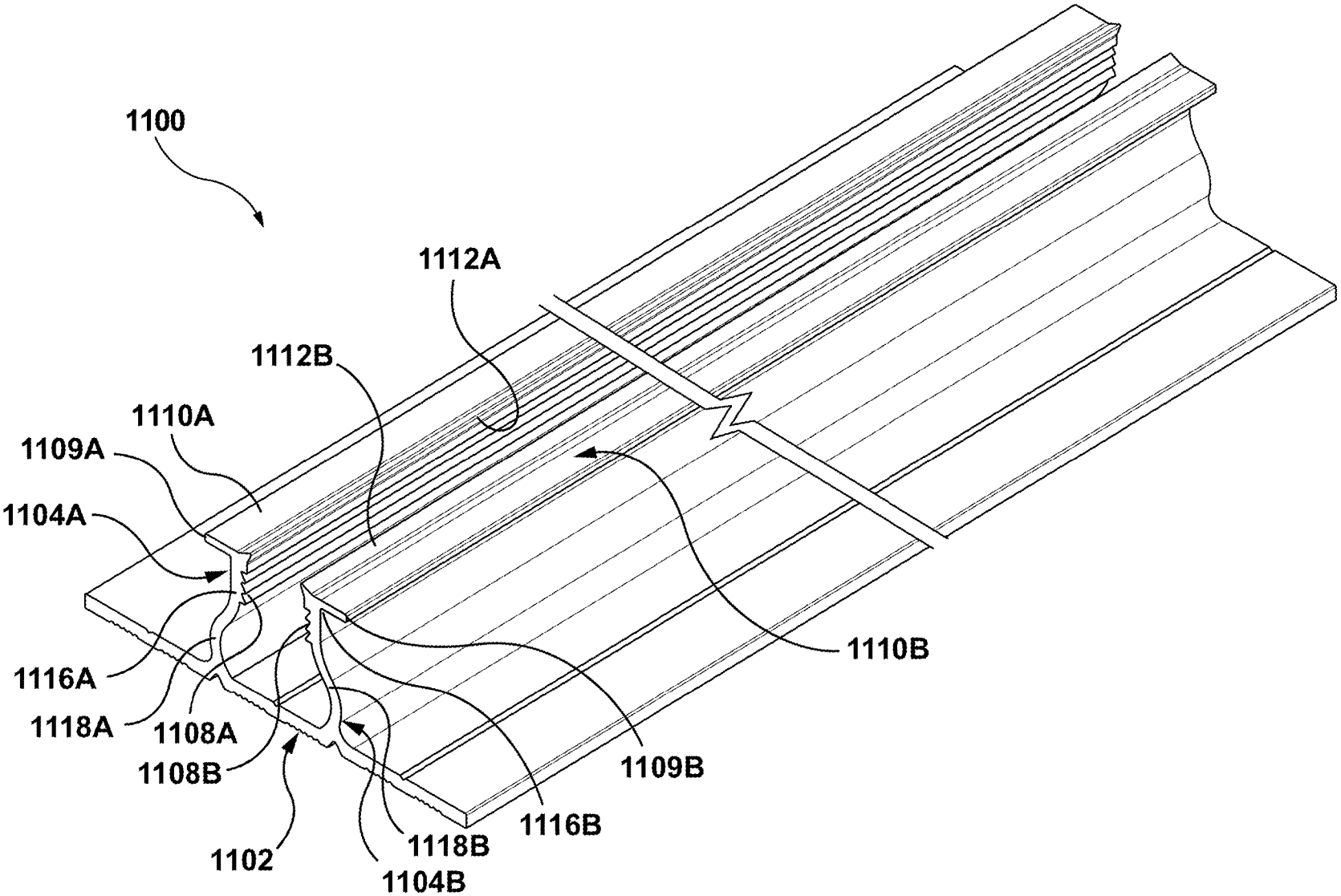
FIG. 11B is a first isometric view of the extrusion profile bracket of FIG. 11A.
Figure 11C:
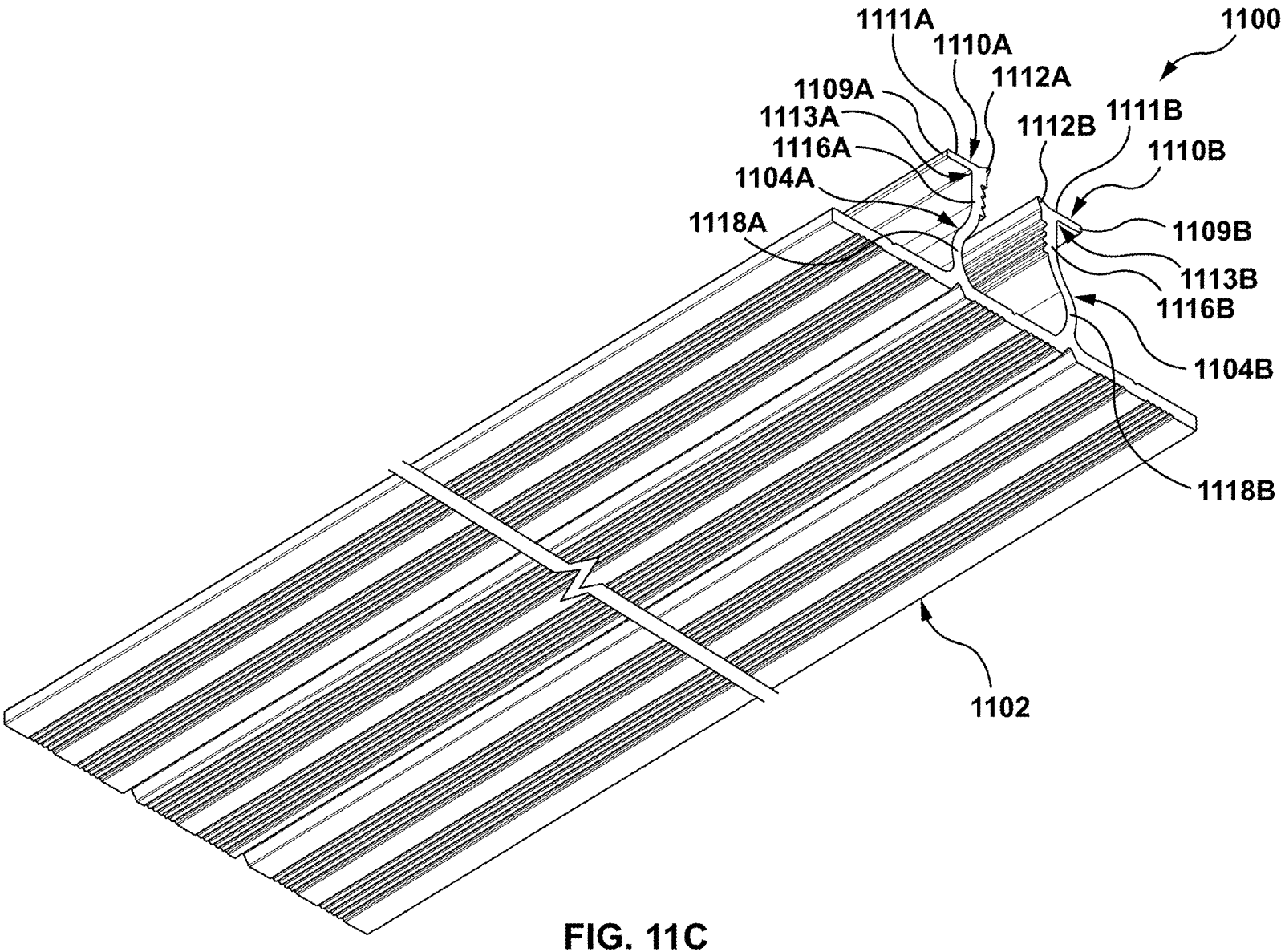
FIG. 11C is a second isometric view of the extrusion profile bracket of FIG. 11A.

FIGS. 11A to 11C show an illustrative embodiment of a fourth extrusion profile bracket, indicated generally by reference 1100. The fourth extrusion profile bracket 1100 is similar in structure to the third extrusion profile bracket 900, except that the fourth extrusion profile bracket 1100 omits any brace between the opposed support legs. Thus, like reference numerals refer to like features, except with the prefix "11" instead of "9".

The fourth extrusion profile bracket 1100 comprises a mounting base 1102, a first support leg 1104A extending from the mounting base 1102, and a second support leg 1104B extending from the mounting base 1102 opposite the first support leg 1104A. The first support leg 1104A has a plurality of first support leg panel gripping teeth 1108A extending from the first support leg 1104A toward the second support leg 1104B. The second support leg 1104B likewise has a plurality of second support leg panel gripping teeth 1108B that extend from the second support leg 1104B toward the first support leg 1104A. Thus, the first support leg panel gripping teeth 1108A and the second support leg panel gripping teeth 1108B are arranged in opposition to, and in registration with, one another. The support leg panel gripping teeth 1108A, 1108B do not have to be distributed identically on each of the first support leg 1104A or second support leg 1104B although they are shown as such in the illustrative embodiment. They may be spaced apart, be larger or smaller than shown, have varying shapes and cross-sections, or take any other arrangement so long as they grip the panels which are received. The first and second support legs 1104A, 1104B may be symmetrical with one another, or asymmetrical. The first support leg 1104A terminates in a first support foot 1110A with a forefoot portion 1109A extending oppositely to the first support leg panel gripping teeth 1108A and away from the second support leg 1104B. Similarly, the second support leg 1104B terminates in a second support foot 1110B with a forefoot portion 1109B that extends oppositely to the second support leg panel gripping teeth 1108B and away from the first support leg 1104A. The first support foot 1110A has a first locking heel 1112A that extends toward the second support leg 1104B and extends beyond termini of the first support leg panel gripping teeth 1108A. Likewise, the second support foot 1104B similarly has a second locking heel 1112B that extends toward the first support leg 1104A and extends beyond termini of the second support leg panel gripping teeth 1108B.

Figure 12A:
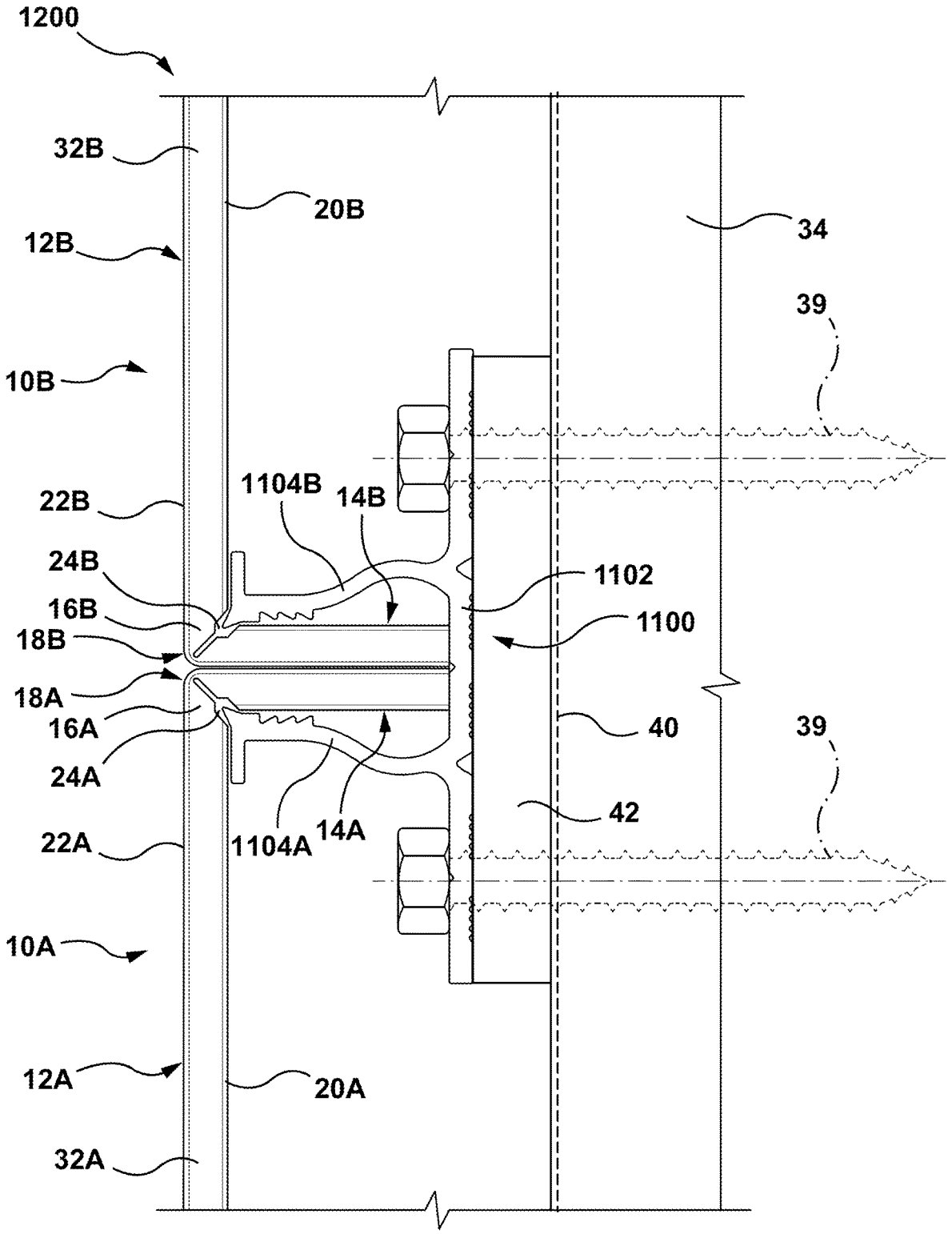
FIG. 12A shows a vertical joint mounting for two panels using the extrusion profile bracket of FIG. 11.
Figure 12B:
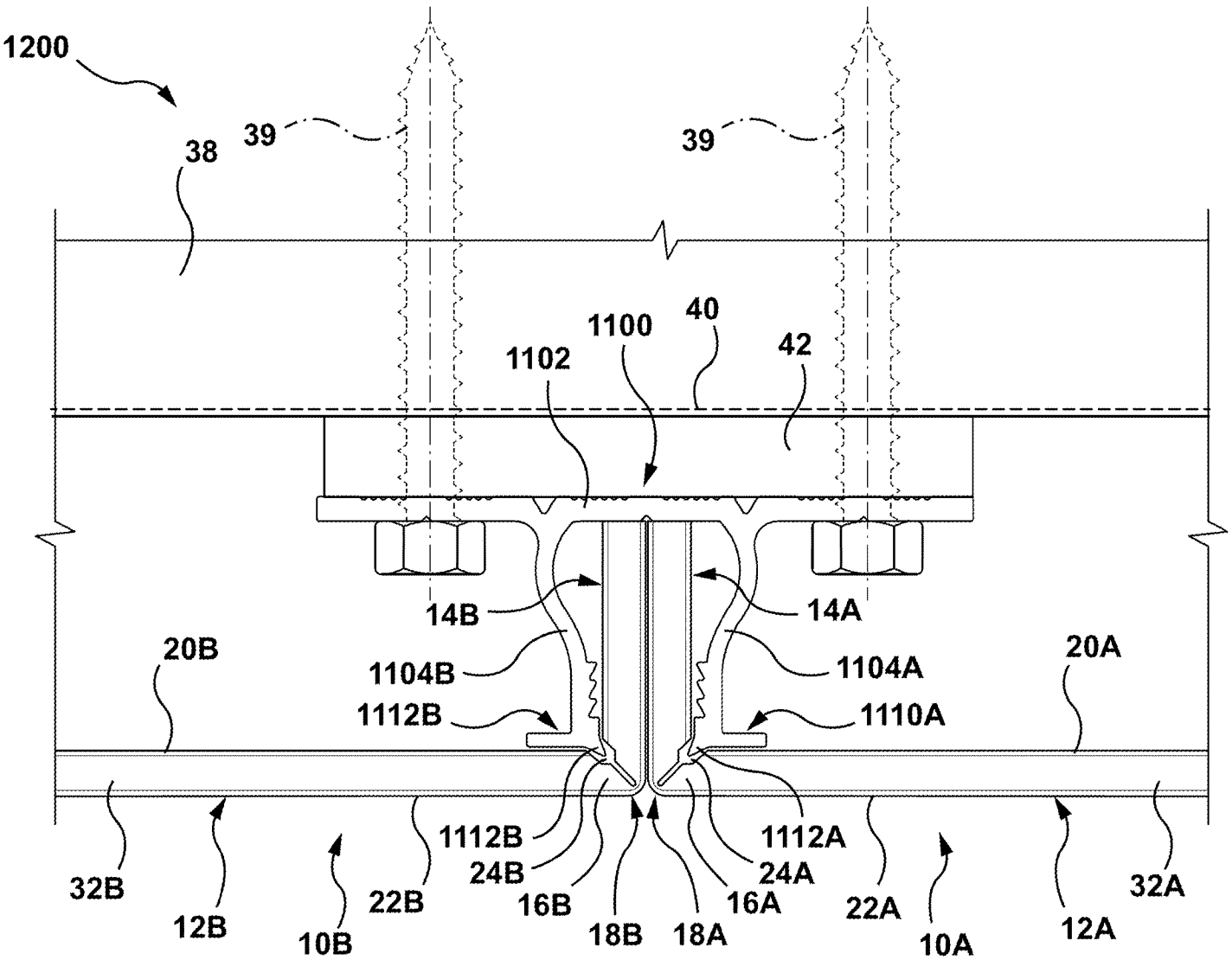
FIG. 12B shows a horizontal joint mounting for two panels using the extrusion profile bracket of FIG. 11.

One or more instances of the fourth extrusion profile bracket 1100 may form part of a fourth illustrative composite panel system, indicated generally by reference 1200 in FIGS. 12A and 12B, in which the fourth extrusion profile bracket 1100 is used to join panels. The fourth composite panel system 1200 comprises at least one instance of the fourth extrusion profile bracket 1100, a first panel 10A and a second panel 10B. FIG. 12A shows a vertical joint and FIG. 12B shows a horizontal joint. The fourth extrusion profile bracket 1100 is secured by way of screws 39 or other suitable fasteners passing through a corresponding aperture in the mounting base 1102 into a wall 34 or ceiling 38. An optional a/v barrier 40 and shim 42 are interposed between the mounting base 1102 and the wall 34 or ceiling 38, as described above in respect of the third composite panel system 1000.

In the fourth illustrative composite panel system 1200, both the first panel mounting flange 14A and the second panel mounting flange 14B are received between the first support leg 1104A and the second support leg 1104B, with the panel outer surfaces 22A, 22B on the panel mounting flanges 14A, 14B in contact with one another. The combined thickness of the two panel mounting flanges 14A, 14B is preferably slightly greater than the space between the respective support leg panel gripping teeth 1108A, 1108B so that the resilient bias of each calf portion 1116A, 1116B assists in clamping the respective panel mounting flanges 14A, 14B between the respective opposed support leg panel gripping teeth 1108A, 1108B. The first support foot 1110A abuts the first panel facing 12A on the first panel inner surface 20A and the first locking heel 1112A extends into the first panel notch 24A to form an interference fit with the first panel mounting flange 14A. The interference fit will obstruct withdrawal of the first panel mounting flange 14A from between the first support leg 1104A and the brace 1106. Similarly, the second support foot 1110B abuts the second panel facing 12B on the second panel inner surface 20B and the second locking heel 1112B extends into the second panel notch 24B to obstruct withdrawal of the second panel mounting flange 14B from between the second support leg 1104B and the brace 1106.

Figure 13:
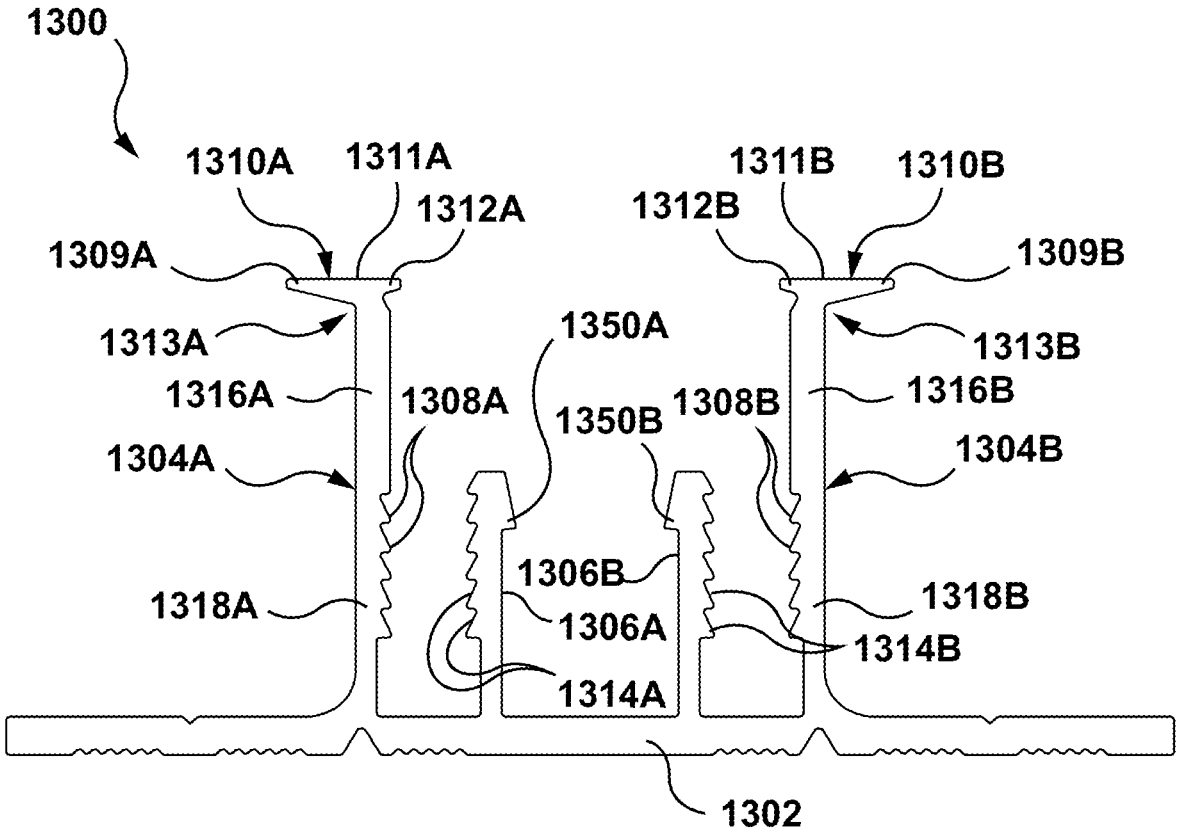
FIG. 13 is a side elevation view of a fifth illustrative extrusion profile bracket.

Reference is now made to FIG. 13, which shows a fifth illustrative extrusion profile bracket, indicated generally by reference 1300. The fifth extrusion profile bracket 1300 may be used to join adjacent panels to one another and may be conceptualized as comprising two variants of the first extrusion profile bracket 100 oriented end-to-end and sharing a common mounting base. Thus, like reference numerals denoting like features except with the prefix "13" instead of "1" and in some cases with the suffixes "A" and "B".

The extrusion profile bracket 1300 has a single common mounting base 1302. A first support leg 1304A and a first brace 1306A extend from the mounting base 1302, with the first support leg 1304A and the first brace 1306A spaced apart from one another, and a second support leg 1304B and a second brace 1306B also extend from the mounting base 1302, also spaced from one another. The first brace 1306A and the second brace 1306B are immediately adjacent but spaced from one another, so that the first brace 1306A is disposed between the first support leg 1304A and the second brace 1306B and the second brace 1306B is disposed between the second support leg 1304B and the first brace 1306A. In the illustrated embodiment, the first brace 1306A is a mirror image of the second brace 1306B and the first support leg 1304A is a mirror image of the second support leg 1304B such that the extrusion profile bracket 1300 is symmetrical, although other arrangements are also contemplated. In the illustrated embodiment, the support legs 1304A, 1304B are substantially longer than the braces 1306A, 1306B, that is, the first support legs 1304A, 1304B extend substantially further from the mounting base 1302 than do the braces 1306A, 1306B.

The support legs 1304A, 1304B each have respective support leg panel gripping teeth 1308A, 1308B extending from the support legs 1304A, 1304B toward the respective braces 1306A, 1306B, and the braces 1306A, 1306B each have a plurality of brace first panel gripping teeth 1314A, 1314B extending toward the respective support leg panel gripping teeth 1308A, 1308B. Thus, the first support leg panel gripping teeth 1308A and the first brace first panel gripping teeth 1314A extend toward one another and the second support leg panel gripping teeth 1308B and the second brace first panel gripping teeth 1314B extend toward one another. In the illustrated embodiment, the support legs 1304A, 1304B are substantially straight and omit any curvature in the thigh portions 1318A, 1318B thereof (as found in the first extrusion profile bracket 100). The support leg panel gripping teeth 1308A, 1308B are disposed on the respective thigh portions 1318A, 1318B rather than on the calf portions 1316A, 1316B (as in the first extrusion profile bracket 100). This is merely an illustrative embodiment and is not limiting. The thigh portions 1318A, 1318B of the respective support legs 1304A, 1304B extend between the respective calf portions 1316A, 1316B and the mounting base 1302. The support leg panel gripping teeth 1308A, 1308B and the brace first panel gripping teeth 1314A, 1314B are arranged in respective registration with, and in opposition to, the brace first panel gripping teeth 1314A, 1314B. Therefore, the support leg panel gripping teeth 1308A, 1308B and the brace first panel gripping teeth 1314A, 1314B are disposed substantially closer to the mounting base 1302 than in the first extrusion profile bracket 100. In the illustrated embodiment, the support leg panel gripping teeth 1308A, 1308B and the brace first panel gripping teeth 1314A, 1314B are longitudinally co-extensive with one another.

The support legs 1304A, 1304B each terminate in a respective support foot 1310A, 1310B that includes a respective forefoot portion 1309A, 1309B extending oppositely to the respective support leg panel gripping teeth 1308A, 1308B away from the braces 1306A, 1306B, and a respective locking heel 1312A, 1312B that extends toward the braces 1306A, 1306B and extends beyond the termini of the respective support leg panel gripping teeth 1308A, 1308B. In the illustrated embodiment each locking heel 1312A, 1312B extends at a substantially straight angle (about 180°) relative to the respective forefoot portion 1309A, 1309B (i.e. the locking heel 1312A, 1312B and the forefoot portion 1309A, 1309B on each support foot 1310A, 1310B extend in opposite directions). Each support foot 1310A, 1310B includes a respective generally planar sole surface 1311A, 1311B that extends along both the forefoot portion 1309A, 1309B and the locking heel 1312A, 1312B). The sole surfaces 1311A, 1311B will fit flush with an interior surface of a panel received by the extrusion profile bracket 1300 in a manner analogous to that described above in the context of the first composite panel system 100. The support foot can, however, take on other shapes so long as the locking heel extends beyond termini of the respective support leg panel gripping teeth. Each support foot 1310A, 1310B is joined at a respective ankle 1313A, 1313B to the respective calf portion 1316A, 1316B of the respective support leg 1304A, 1304B.

The mounting flange of a first panel can be received between the first support leg 1304A and the first brace 1306A, and the mounting flange of a second panel can be received between the second support leg 1304B and the second brace 1306B. The mounting flanges of the panels are thereby gripped between the respective support leg panel gripping teeth 1308A, 1308B and the brace first panel gripping teeth 1314A, 1314B in a manner analogous to that described above in the context of the first composite panel system 100. As with the first composite panel system 100, the respective locking heels 1312A, 1312B will extend into the respective notches of the panels in an interference fit.

Figure 14:
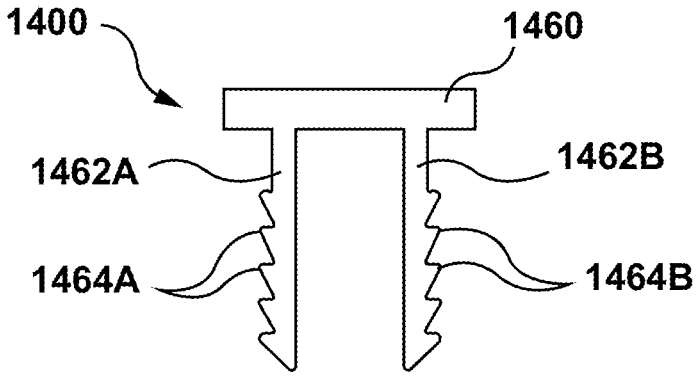
FIG. 14 is a side elevation view of a plug for use with the extrusion profile bracket of FIG. 13.

In the illustrated embodiment, the braces 1306A, 1306B are provided with respective detents 1350A, 1350B each disposed on the opposite side of the respective brace 1306A, 1306B from the respective brace first panel gripping teeth 1314A, 1314B such that the detents 1350A, 1350B extend inwardly toward one another. A plug 1400, shown in FIG. 14, is adapted to fit between the braces 1306A, 1306B and to be retained therein by the detents 1350A, 1350B. The plug 1400 comprises a cover facing 1460 from which depend two support arms 1462A, 1462B having respective outwardly facing plug teeth 1464A, 1464B that are configured to inter-engage with the detents 1350A, 1350B on the respective brace 1306A, 1306B so that the plug 1400 can be retained at various depths.

The extrusion profile brackets described herein may be of any desired length and may be formed by continuous extrusion. In one preferred embodiment, the extrusion profile brackets are formed from aluminum or an aluminum alloy, although other suitable materials may also be used.

Several embodiments have been described by way of example. It will be apparent to person's skilled in the art that a number of variations and modifications can be made without departing from the scope of the claims.

What is claimed is:

1. An extrusion profile bracket for mounting panels, comprising:

a mounting base;

a first support leg extending from the mounting base; and a brace extending from the mounting base and spaced apart from the first support leg;

the first support leg having a plurality of first support leg panel gripping teeth extending from the first support leg toward the brace;

the first support leg terminating in a first support foot including a portion extending oppositely to the first support leg panel gripping teeth and away from the brace;

the first support foot having a first locking heel extending toward the brace and extending beyond termini of the first support leg panel gripping teeth;

the brace having a plurality of brace first panel gripping teeth extending toward the first support leg panel gripping teeth;

wherein the first support leg panel gripping teeth and the brace first panel gripping teeth are arranged in opposition to one another;

wherein the first support leg comprises:

a first generally planar calf portion that carries the first support leg panel gripping teeth and terminates in the first support foot; and a first curved thigh portion extending between the first calf portion and the mounting base and having a concave curvature facing the brace and a curvature facing away from the brace.

2. The extrusion profile bracket of claim 1, wherein the concave curvature facing the brace and the curvature facing away from the brace provide a resilient bias of the first calf portion toward the brace.

3. The extrusion profile bracket of claim 1, further comprising:

a second support leg extending from the mounting base on an opposite side of the brace from the first support leg;

the second support leg having a plurality of second support leg panel gripping teeth extending from the second support leg toward the brace;

the second support leg terminating in a second support foot including a portion extending oppositely to the second support leg panel gripping teeth and away from the brace;

the second support foot having a second locking heel extending toward the brace and extending beyond termini of the second support leg panel gripping teeth;

the brace having a plurality of brace second panel gripping teeth extending toward the second support leg panel gripping teeth;

wherein the second support leg panel gripping teeth and the brace second panel gripping teeth are arranged in opposition to one another.

4. The extrusion profile bracket of claim 3, wherein the second support leg comprises:

a second generally planar calf portion that carries the second support leg panel gripping teeth and terminates in the second support foot; and a second curved thigh portion extending between the second calf portion and the mounting base and having a concave curvature facing the brace and a convex curvature facing away from the brace.

5. The extrusion profile bracket of claim 4, wherein the concave curvature facing the brace and the convex curvature facing away from the brace provide a resilient bias of the second calf portion toward the brace.

6. The extrusion profile bracket of claim 3, wherein the first support leg, the second support leg and the brace form a substantially symmetrical arrangement.

7. A composite panel system comprising:

the extrusion profile bracket of claim 1; and a first panel;

the first panel comprising a first panel facing and a first panel mounting flange depending generally orthogonally from an end of the first panel facing to form a first panel corner between the first panel facing and the first panel mounting flange;

the first panel having a first panel inner surface facing toward the first support leg and a first panel outer surface facing away from the first support leg;

the first panel having a first panel notch formed in the first panel inner surface at the first panel corner;

wherein:

the first panel mounting flange is received between the first support leg and the brace and is gripped by the first support leg panel gripping teeth and the brace first panel gripping teeth;

the first support foot abuts the first panel facing on the first panel inner surface; and the first locking heel extends into the first panel notch to obstruct withdrawal of the first panel mounting flange from between the first support leg and the brace.

8. The composite panel system of claim 7, wherein the first panel is a composite panel wherein the first panel inner surface and the first panel outer surface are formed by respective first panel metal layers and wherein a first panel intermediate layer of filler is disposed between the first panel metal layers.

9. The composite panel system of claim 8 wherein the first panel notch extends entirely through the first panel metal layer forming the first panel inner surface and into the first panel intermediate layer of filler.

10. A composite panel system of claim 7, wherein the extrusion profile bracket further comprises:

a second support leg extending from the mounting base on an opposite side of the brace from the first support leg;

the second support leg having a plurality of second support leg panel gripping teeth extending from the second support leg toward the brace;

the second support leg terminating in a second support foot including a portion extending oppositely to the second support leg panel gripping teeth and away from the brace;

the second support foot having a second locking heel extending toward the brace and extending beyond termini of the second support leg panel gripping teeth;

the brace having a plurality of brace second panel gripping teeth extending toward the second support leg panel gripping teeth;

the composite panel system further comprising a second panel;

wherein:

the second support leg panel gripping teeth and the brace second panel gripping teeth are arranged in opposition to one another;

the first panel comprising a first panel facing and a first panel mounting flange depending generally orthogonally from an end of the first panel facing to form a first panel corner between the first panel facing and the first panel mounting flange;

the first panel having a first panel inner surface facing toward the first support leg and a first panel outer surface facing away from the first support leg;

the first panel having a first panel notch formed in the first panel inner surface at the first panel corner;

the second panel comprising a second panel facing and a second panel mounting flange depending generally orthogonally from an end of the second panel facing to form a second panel corner between the second panel facing and the second panel mounting flange;

the second panel having a second panel inner surface facing toward the second support leg and a second panel outer surface facing away from the second support leg;

the second panel having a second panel notch formed in the second panel inner surface at the second panel corner;

the first panel mounting flange is received between the first support leg and the brace and is gripped by the first support leg panel gripping teeth and the brace first panel gripping teeth;

the first support foot abuts the first panel facing on the first panel inner surface;

the first locking heel extends into the first panel notch to obstruct withdrawal of the first panel mounting flange from between the first support leg and the brace;

the second panel mounting flange is received between the second support leg and the brace and is gripped by the second support leg panel gripping teeth and the brace second panel gripping teeth;

the second support foot abuts the second panel facing on the second panel inner surface; and the second locking heel extends into the second panel notch to obstruct withdrawal of the second panel mounting flange from between the second support leg and the brace.

11. The composite panel system of claim 10, wherein:

the first panel is a composite panel wherein the first panel inner surface and the first panel outer surface are formed by respective first panel metal layers and wherein a first panel intermediate layer of filler is disposed between the first panel metal layers; and the second panel is a composite panel wherein the second panel inner surface and the second panel outer surface are formed by respective second panel metal layers and wherein a second panel intermediate layer of filler is disposed between the second panel metal layers.

12. The composite panel system of claim 11, wherein:

the first panel notch extends entirely through the first panel metal layer forming the first panel inner surface and into the first panel intermediate layer of filler; and the second panel notch extends entirely through the second panel metal layer forming the second panel inner surface and into the second panel intermediate layer of filler.

13. An extrusion profile bracket for mounting panels, comprising:

a mounting base;

a first support leg extending from the mounting base;

a second support leg extending from the mounting base opposite the first support leg;

the first support leg having a plurality of first support leg panel gripping teeth extending from the first support leg toward the second support leg;

the first support leg terminating in a first support foot including a portion extending oppositely to the first support leg panel gripping teeth and away from the second support leg;

the first support foot having a first locking heel extending toward the second support leg and extending beyond termini of the first support leg panel gripping teeth;

the second support leg having a plurality of second support leg panel gripping teeth extending from the second support leg toward the first support leg;

the second support leg terminating in a second support foot including a portion extending oppositely to the second support leg panel gripping teeth and away from the first support leg;

the second support foot having a second locking heel extending toward the first support leg and extending beyond termini of the second support leg panel gripping teeth; and wherein the first support leg panel gripping teeth and the second support leg panel gripping teeth are arranged in opposition to one another;

wherein the first support leg comprises:

a first generally planar calf portion that carries the first support leg panel gripping teeth and terminates in the first support foot; and a first curved thigh portion extending between the first calf portion and the mounting base and having a concave curvature facing the second support leg and a curvature facing away from the second support leg; and wherein the second support leg comprises:

a second generally planar calf portion that carries the second support leg panel gripping teeth and terminates in the second support foot; and a second curved thigh portion extending between the second calf portion and the mounting base and having a concave curvature facing the first support leg and a curvature facing away from the first support leg.

* * * * *